US005192065A

United States Patent [19]

Hirota et al.

[11] Patent Number: 5,192,065

[45] Date of Patent: Mar. 9, 1993

[54] SORTER WITH TRAYS ROTATABLE INTO A STAPLING POSITION

[75] Inventors: Kazuhiro Hirota, Hachioji; Hisao Hosoya, Sagamihara; Yasushi Yamada, Tachikawa; Kazunobu Miura, Hachioji; Akihiko Nishiki, Hachioji, all of Japan

[73] Assignee: Konica Corporation, Tokyo, Japan

[21] Appl. No.: 815,416

[22] Filed: Dec. 31, 1991

[30] Foreign Application Priority Data

| | | | |
|---|---|---|---|
| Jan. 16, 1991 | [JP] | Japan | 3-003379 |
| Feb. 25, 1991 | [JP] | Japan | 3-030364 |
| Mar. 15, 1991 | [JP] | Japan | 3-051302 |
| Apr. 2, 1991 | [JP] | Japan | 3-069908 |

[51] Int. Cl.[5] ..... B42B 2/00; B65H 39/02

[52] U.S. Cl. ..... 270/53; 270/58

[58] Field of Search ..... 270/37, 53, 58

[56] References Cited

U.S. PATENT DOCUMENTS

| | | | |
|---|---|---|---|
| 4,083,550 | 4/1978 | Pal | 270/58 |
| 4,376,529 | 3/1983 | George | 270/53 |
| 4,382,592 | 5/1983 | Harding | 270/58 |
| 5,092,509 | 3/1992 | Naito | 270/53 |

FOREIGN PATENT DOCUMENTS

| | | | |
|---|---|---|---|
| 99894 | 4/1991 | Japan | 270/53 |
| 143690 | 6/1991 | Japan | 270/53 |

OTHER PUBLICATIONS

*Xerox Disclosure Journal*, "Drum Collator, Stecker, finisher", vol. 2, No. 5; Sep./Oct. 1977 p. 77.

*Primary Examiner*—Edward K. Look
*Assistant Examiner*—John Ryznic
*Attorney, Agent, or Firm*—Finnegan, Henderson, Farabow, Garrett and Dunner

[57] ABSTRACT

A sheet sorting machine for sorting plural sheets to plural groups and stapling the sheets by the group. The sheet sorting machine has a sorting assembly to convey the sheets to the plural bins by the group; a positioning member to true up the sheets to a setting position in each of the bins; a member to fix the sheets in the bins; oscillator to move the bins, holding the sheets at the setting position in the bins, to a stapling position; and stapler to staple the sheets at the stapling position; in which the fixing member fixes the sheets before the oscillator sets the sheets to the stapling position.

13 Claims, 27 Drawing Sheets

FIG. 2-A
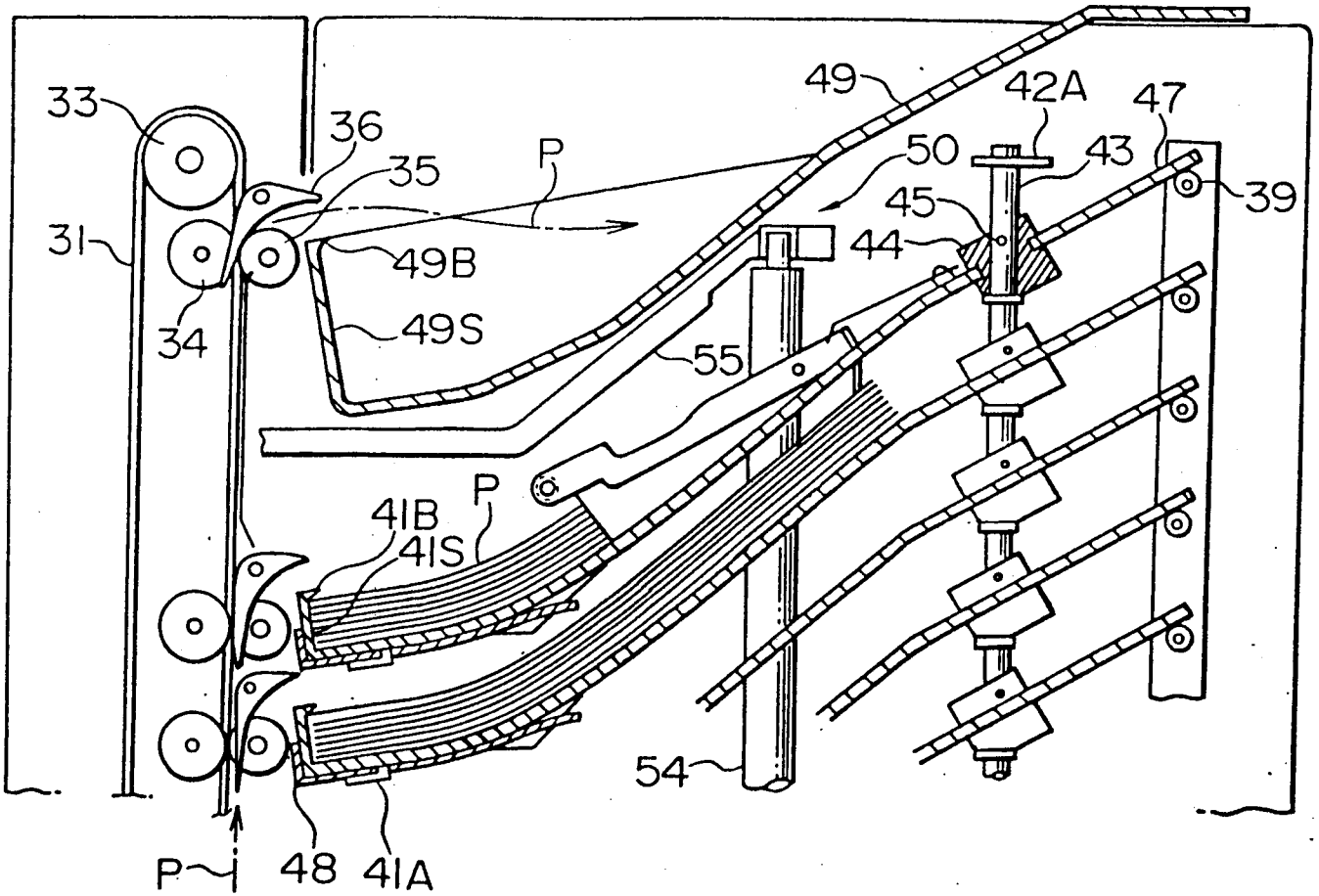

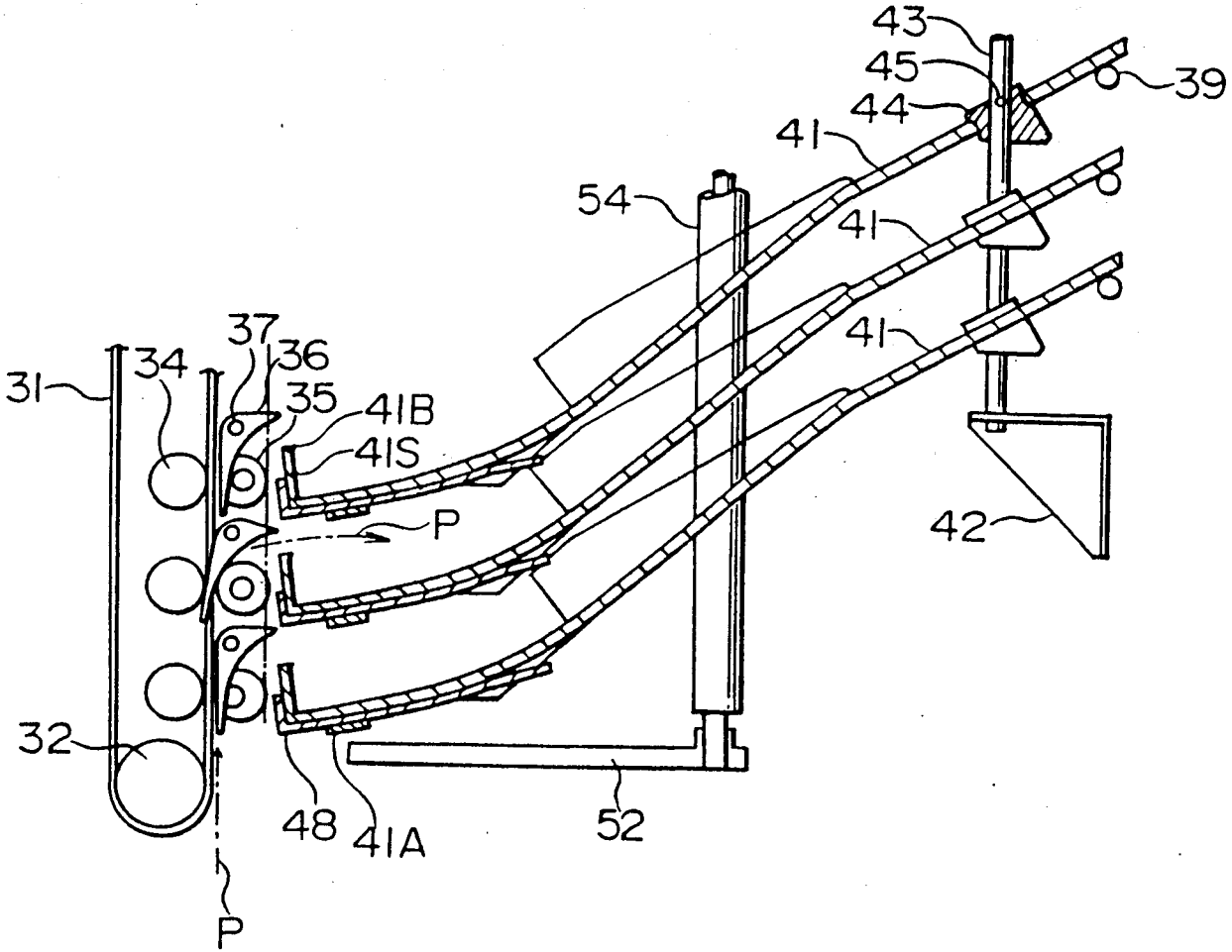
FIG. 2-B

SORTER WITH TRAYS ROTATABLE INTO A STAPLING POSITION

BACKGROUND OF THE INVENTION

The present invention relates to a sorter which is provided to an image forming apparatus such as a copier and printer to sort sheets discharged from the apparatus, and more particularly relates to a sorter having a plurality of bins, and the sorter is provided with a stapling device to arrange and staple the sheets in the bin.

For a sheet processing device provided with a stapling device to staple sheets discharged from a copier, printer and the like, a sheet finisher has been utilized which is installed together with an automatic recirculating document handler in order to staple the sheets. However, the aforementioned sheet finisher is disadvantageous because the structure is so complicated and expensive.

(1) In Japanese Patent Publication Open to Public Inspection no. 43457/1989, has been disclosed an apparatus in which a stapling device is provided to a relatively simple bin-moving type of sorter. In the aforementioned apparatus, a stapling device to staple sheets sorted into a bin can be freely moved with regard to the bin.

(2) Another sorter is composed in such a manner that: a fixed type of stapling device is provided to each bin; and the bin is moved to the stapling position so that a bundle of sheets can be stapled.

(3) A sorter disclosed in the official gazette of Japanese Patent Publication Open to Public Inspection No. 244869/1987, is composed in such a manner that: a bin having sheets is moved to a position where a stapling operation can be conducted; the sheets are stapled by a stapling device; and when the sheets in other bins are stapled, the stapling device is moved in a vertical direction.

In the aforementioned sorter of case (1) having a stapling device which can be moved freely, the moving stroke of the stapling device is different according to sheet size. Accordingly, when the vertical spacing of each bin is set large, the sorter size becomes large as a whole, and when the vertical spacing of a bin into which the stapling device is inserted, is extended, the mechanism becomes complicated.

In the aforementioned sorter of case (2), the structure of the sorter is complicated as a whole, and in the case where the vertical spacing of the bin is small, a special stapling device is required.

In the aforementioned sorter of case (3), each bin in which sheets are put, is moved straight along a bin guide at an appropriate time. Accordingly, it is disadvantageous in that the structure becomes complicated.

In any sorters, when the sheets aligned on a bin are moved to a stapling position, or when the stapler is inserted between bins, the bundle of sheets are not fixed at all, so that the sheets are stapled without being aligned before the stapling operation. Accordingly, the bundle of sheets becomes irregular.

The first object of the present invention is to provide a composition by which sheets can be stapled at a constant position even in the case of a relatively simple sorter when the sheets are fixed being aligned just before the bin is moved.

As sorter systems which automatically sort a plurality of sheets (copy sheets) discharged from an image forming apparatus such as a copier, there are a fixed bin system, an all bin shifting system, and a bin opening movement system.

In the case of the fixed bin system, a plurality of copies are made from a plurality of documents by an image forming apparatus in such a manner that: the sheets conveyed from the image forming apparatus are successively received by a receiving section of a sorter; then the sheets are moved to a conveyance section; as shown in FIG. 1, while the sheets are being conveyed, they are successively taken into bins 41 by a sorting guide 36 and a delivery roller 35 which are installed in the receiving portion of the bin 41.

The aforementioned bin fixed system is advantageous in that: a relatively large number of sheets can be put into the bin: the sorter can respond at a high speed; and a plurality of sorters can be connected. Therefore, this type of sorter is frequently applied to a console type of high speed copier. For example, 50 sheets can be stacked in each of the bins for sorting use, and 250 sheets can be stacked on a tray for non-sorting use.

The sheets discharged from the aforementioned image forming apparatus are received by the sorter of the aforementioned bin fixed system, and then conveyed at a high speed in a conveyance passage formed in the sorter into the aforementioned bins through the aforementioned branch means.

When a sheet SA2 of a small size conveyed to the bin at a high speed is discharged, sheet SA2 is branched by the branch means 36, pinched by the paper discharging roller 35 and the conveyance belt 31, and discharged at a high speed as shown in FIG. 25(A). Since the weight of small-sized sheet SA2 (for example, a sheet of B4-size or A4-size) is light, an area of the frictional surface of the sheet is small, so that sheet S2A is carried too far jumping over the uppermost portion of the stacked sheets and does not slip down to a predetermined position. Accordingly, sheet S2A is not contacted with stopper wall 41S of the bin 41, so that the bundle of sheets become irregular. When the following sheets are discharged into the bin 41 under the aforementioned condition, the sheets are bumped with each other and a failure in conveyance such as a jam occurs. The conveyance failure tends to occur when a large number of sheets are stacked in the bin 41. In the case of a sorter provided with a stapler, the irregular bundle of sheets are stapled.

When a large-sized sheet S2B (for example, A3-size or B4-size) is discharged onto the bin 41, sheet S2B comes into contact with the uppermost sheet as shown in FIG. 25(B) since the weight of sheet S2B is heavy and the frictional surface is large, so that the movement of sheet S2B is interrupted. Therefore, the trailing edge of the sheet remains on the upper edge of the stopper wall of the bin 41, so that a jam is caused.

The second object of the present invention is to solve the aforementioned problems, and more particularly to provide a sorter characterized in that: a jam caused by a failure in sheet conveyance can be prevented when sheets are conveyed at a high speed; and the sheets can be positively aligned in the bin.

SUMMARY OF THE INVENTION

The present invention has been achieved under the circumstances described above. A sorter with a stapler according to the present invention by which the aforementioned first object can be accomplished, having a plurality of bins to sort and hold discharged sheets, and a stapling device to staple the sheets held in the aforementioned bins, comprises: a bin oscillating means which oscillates the sheets stacked in the aforementioned bins to set the sheets in a position where a stapling operation can be conducted; and a sheet holding means which presses the upper surface of the sheets immediately before the oscillation of the bins to fix the sheets to the bins so that the sheets can be maintained to a stapling position.

The sorter to accomplish the aforementioned second object of the present invention which conveys sheets discharged from an image forming apparatus and sorts the sheets into a plurality of bins, comprises: a sheet conveyance drive means to variably change the linear velocity of sheets discharged into the aforementioned bins; and a control means to variably control the linear velocity of the sheets discharged by the aforementioned sheet conveyance drive means, wherein the linear velocity of small-sized discharged sheets is set lower than that of large-sized discharged sheets.

BRIEF DESCRIPTION OF THE DRAWINGS

FIGS. 2A and 2B are partial sectional views of the members of the branched conveyance passage for papers, and the bins of the sorter;

DESCRIPTION OF THE PREFERRED EMBODIMENTS

With reference to the drawings, the first embodiment of the present invention will be explained as follows.

Figure 1:
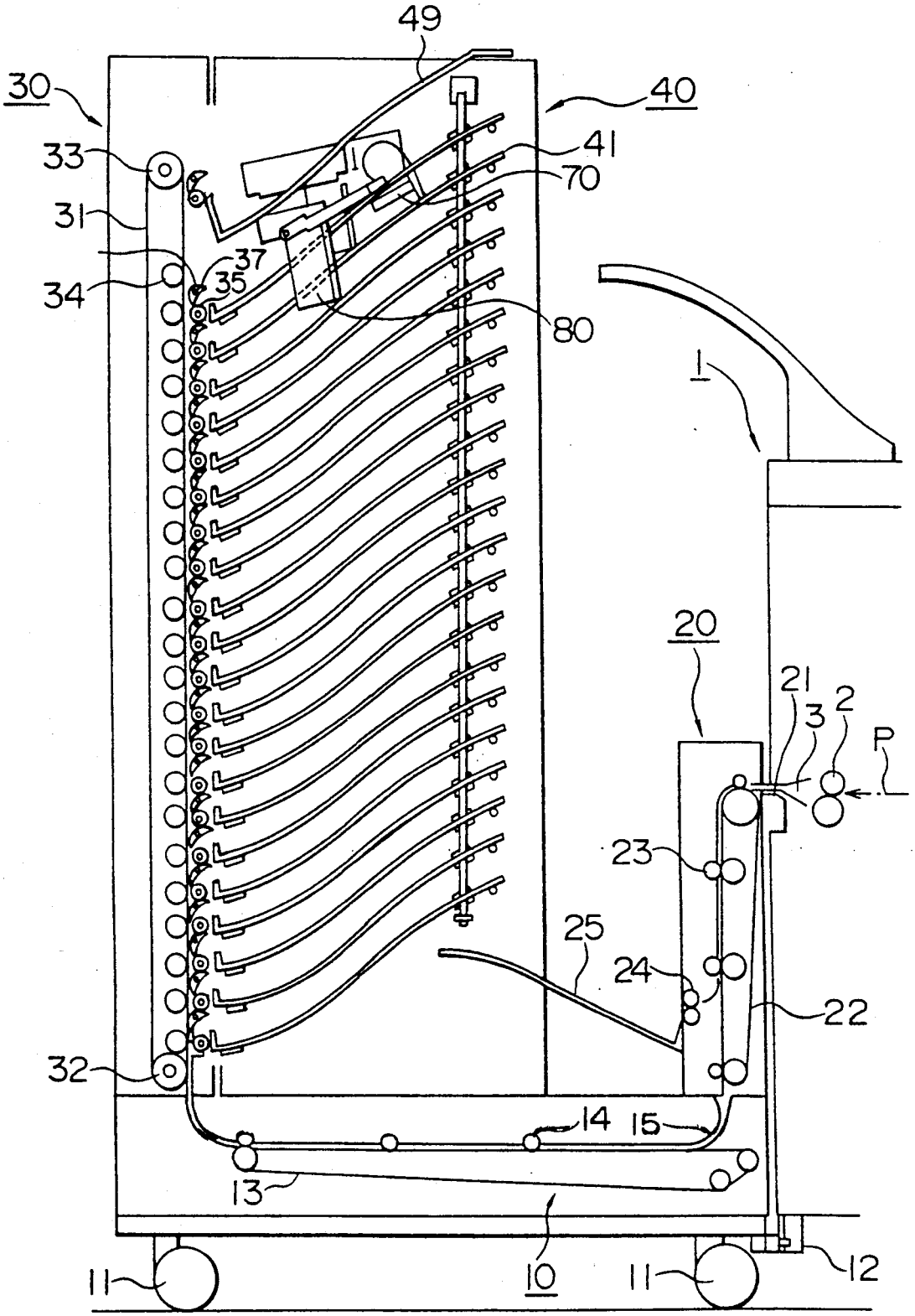
FIG. 1 is a view showing the structure of a sorter connected with an image forming apparatus body.

FIG. 1 is a view showing the structure of a sorter which is connected with a main body 1 of an image forming apparatus (for example, a copier). The sorter of the present invention comprises a base frame 10, downward conveyance section 20, upward conveyance section 30, and bin shift section 40.

The base frame 10 includes a caster 11, connecting means 12 to connect the base frame 10 with a recording unit, conveyance belt 13, idle roller 14, guide plates 15A, 15B, and drive means (not shown in the drawing), and the base frame 10 is fixed to the floor.

The downward conveyance section 20 is connected with paper discharging rollers 2 and a discharging port 3 of the image forming apparatus 1. The downward conveyance section 20 is composed of a guide plate 21 to receive a discharged sheet P so that it can be conveyed downward, a conveyance belt 22 and idle rollers 23 to convey sheet P to the conveyance belt 13 in the aforementioned base frame 10, and the like. A conveyance means 24 and tray 25 are branched from the conveyance passage, which are utilized for discharging a preceding sheet in the image forming apparatus 1 when a jam has occurred in the image forming apparatus 1. The upper portion of the frame corresponding to the aforementioned downward conveyance section 20 is freely opened and closed so that a jammed paper in the downward conveyance section 20 can be removed.

In the upper conveyance section 30, several endless conveyance belts 31 are provided between pulleys 32 and 33 which are rotatably mounted on the upper and lower portion of the support frame. A plurality of rollers 34 corresponding to the insert ports of the bins are provided inside the conveyance belt 31 in such a manner that the rollers 34 are rotatably contacted with the conveyance belt 31. A plurality of conveyance rollers 35 are provided outside the conveyance belt 31 correspondingly to the rollers 34 in such a manner that the conveyance rollers 35 are rotatably contacted with the conveyance belt 31.

Branch guides 36 are disposed between the conveyance rollers 35 at the entrances of the bins, and oscillated to guide the papers. These branch guides 36 are rotatably supported by shafts 37 which are provided to the aforementioned support frame, and oscillated by levers provided at the ends of shafts 37 and solenoids, wherein the levers and solenoids are not illustrated in the drawing. Accordingly, when a branch guide 36 is rotated clockwise, the lower edge claw portion of the branch guide 36 is crossed with a paper conveyance passage composed of the conveyance belt 31 and the conveyance roller 35 so that the paper can not be conveyed upward. In this way, the branch guide 36 is prepared for receiving papers. When a paper P is conveyed under the aforementioned condition, paper P is curved along the inner curved surface of the branch guide 36 in the direction of a right angle, and paper P is received by bin 41.

FIG. 2 is a partial sectional view of the composing members of the aforementioned branch conveyance passage and the bin.

Figure 3:
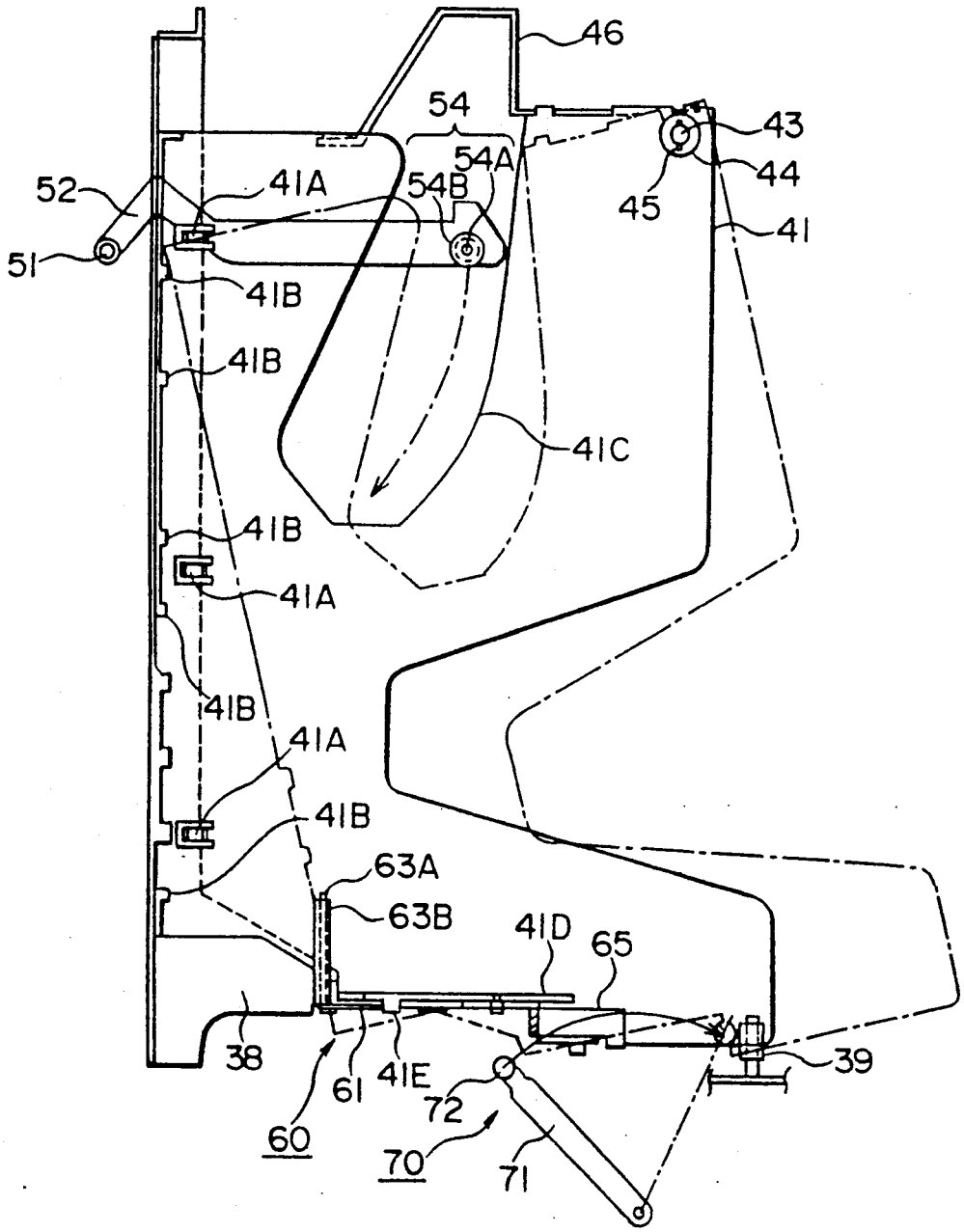
FIG. 3 is a plan view of a bin.

FIG. 3 is a plan view of the bin 41.

In the bin shift section 40, a plurality of bins (for example, 20 bins) 41 which are disposed at regular intervals, are supported in such a manner that the bins can be freely oscillated. That is, the bottom portion (the left portion shown in FIG. 2) of the bin 41 is slidably supported on a guide plate 48 which is fixed to the bin shift section 30.

A vertical fixed shaft 43 which is supported by supporting members 42 mounted on the upper and lower portions of the frame of the bin shift section, is engaged with a slide member 44 which is positioned by a pin 45. The slide member 44 is inserted into a hole formed at one end (the right upper portion shown in FIGS. 2 and 3) of the aforementioned bin 41, so that the bin 41 can be freely rotated. The pins 45 mounted on the fixed shaft 43 at regular intervals, are engaged with the cut-out portions of the slide members 44, so that the edge portions of the bins 41 are held in parallel at regular intervals.

The other end portion of the bin 41 is supported by a rotatable roller 39 which is mounted on a portion of the frame of the bin shift section 40. In the manner described above, the bin 41 is supported by the guide plate 48, slide member 44 and roller 39, and freely rotated around the fixed shaft 43. Numeral 41A in the drawing represents 3 claws which engage with cut-out portions of the guide plate 48. Numeral 41B represents 5 front stoppers provided on the paper guide side of the upper surface of the bin 41. The upper edge of the vertical surface of the stopper is curved so that it can be formed claw-shaped in order to prevent a paper from getting out of the bin in the case where the trailing edge of the paper is raised.

Figure 4:
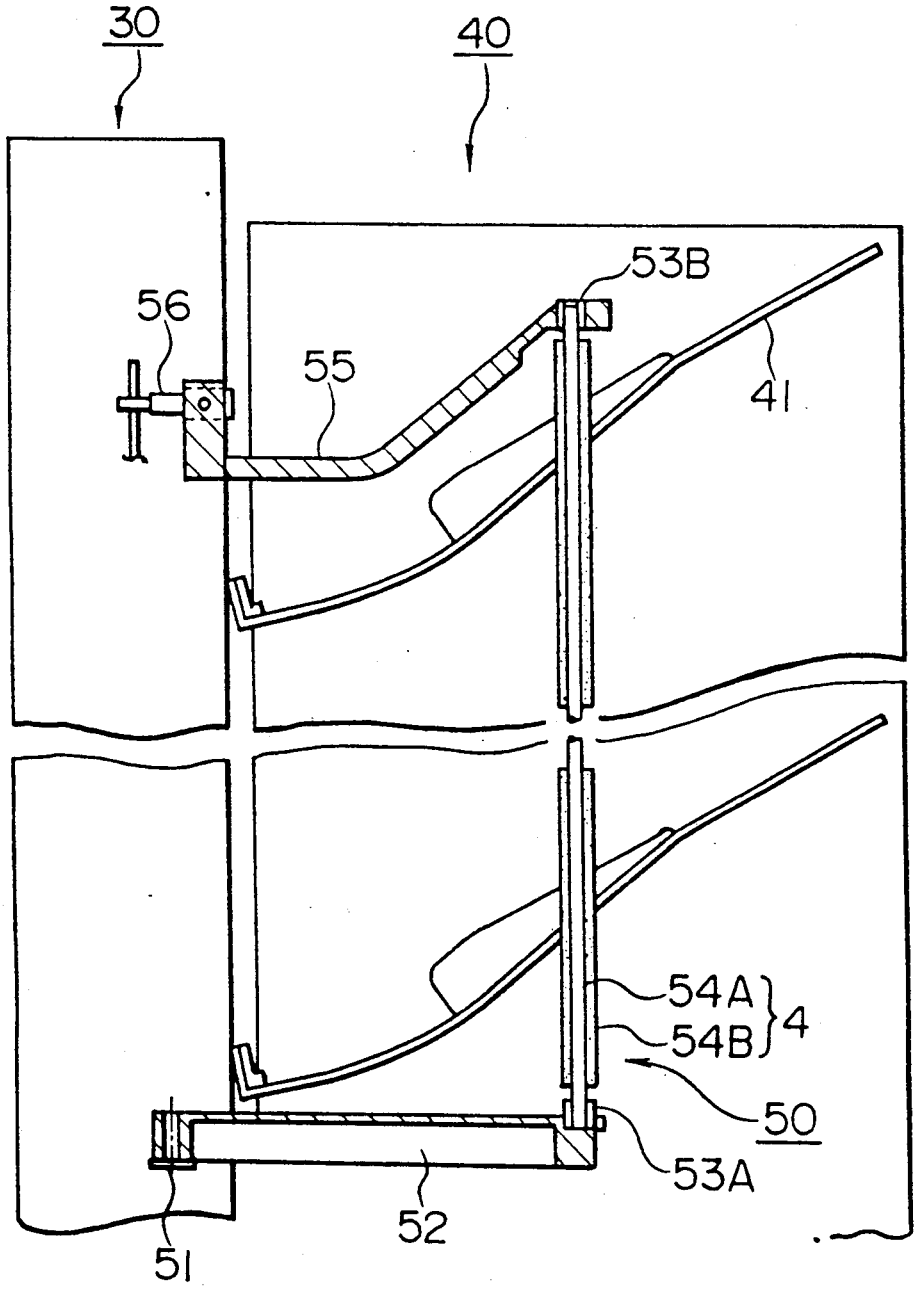
FIG. 4 is a sectional front view of the alignment device.
Figure 5:
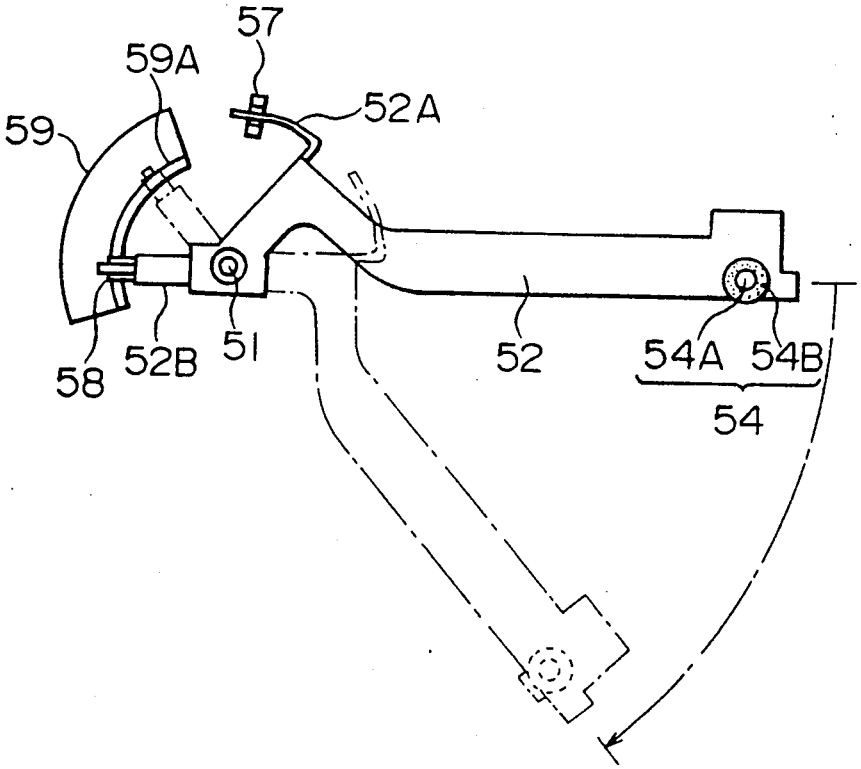
FIG. 5 is a plan view of the alignment device.

On the other hand, an alignment member 50 which aligns the side of paper P discharged from the copier 1 onto the bin 41, is provided in one portion of the fixed frame of the upward conveyance section 30. FIG. 4 is a sectional front view of the alignment device 50, and FIG. 5 is a plan view of the alignment device 50.

In the alignment device 50, a lower arm 52 is engaged with a lower shaft 51 mounted on the lower portion of the aforementioned frame so that it can be freely oscillated by a pulse motor (not illustrated in the drawing). A lower shaft end of a core bar 54A of an alignment rod 54 is supported by an aligning bearing 53A at the tip of the lower arm 52. The circumference of the core bar 54A of the alignment rod 54 is covered with a resilient member 54B made of a foam material such as sponge, and the resilient member 54B is contacted with the side of paper P so that the side of paper P can be aligned.

An upper shaft end of the core bar 54A of the aforementioned alignment rod 54 is supported by an aligning bearing 53B mounted on the shaft end of an upper arm 55. The upper arm 55 is engaged with an upper shaft 56 mounted on the upper portion of the aforementioned frame so that the upper arm 55 can be rotated.

An arc-shaped curved portion 52A is protruded from a portion of the aforementioned lower arm 52, and when an optical path of a photo-interrupter 57 is interrupted, the home position of the lower arm is detected.

The oscillating angle of the aforementioned lower arm 52 can be changed when the setting pulse number of the aforementioned pulse motor is changed so that paper P can be aligned in accordance with the size of paper P.

A roller 58 is rotatably engaged with a protruded shaft portion 52B which is protruded from a portion of the aforementioned lower arm 52. The roller 58 is slidably contacted with a groove cam portion 59A of a cam member 59 which is fixed to the aforementioned frame. Accordingly, when the lower arm 52 is oscillated around the lower shaft 51, the lower arm 52 is also oscillated in the direction of the shaft. When the aforementioned oscillation is conducted, papers P put on the bin 41 are aligned by the oscillation of the alignment rod 54, and the side of the paper can be pressed downward so that the paper can be aligned.

The aforementioned alignment rod 54 moves along a locus which is shown by a one-dotted chain line in FIG. 3. On the other hand, in order to insert papers on the bin 41 into a stapling member, the bin 41 is oscillated as shown by a one-dotted chain line in FIG. 5. Since the bin 41 is moved forward and backward, a large curved opening portion 41C is formed in the bin 41 as shown in the drawing so that the alignment rod 54 can not interfere with the bin 41. Numeral 46 is a reinforcing member to reinforce the opening portion 41C of the bin 41 in order to prevent deformation of the bin 41 caused by the opening portion 41C. This reinforcing member is fixed to the side of the bin 41 by screws, and at the same time engaged with a groove of the bin 41 into which the aforementioned slide member 44 is inserted, in order to prevent the slide member 44 from getting out.

A stopper wall 41D is provided vertically on one side of the aforementioned bin 41. The inner side of the aforementioned stopper wall 41D is formed wave-shaped so that air can pass through a gap formed by the bundle stacked on the bin 41.

Figure 6:
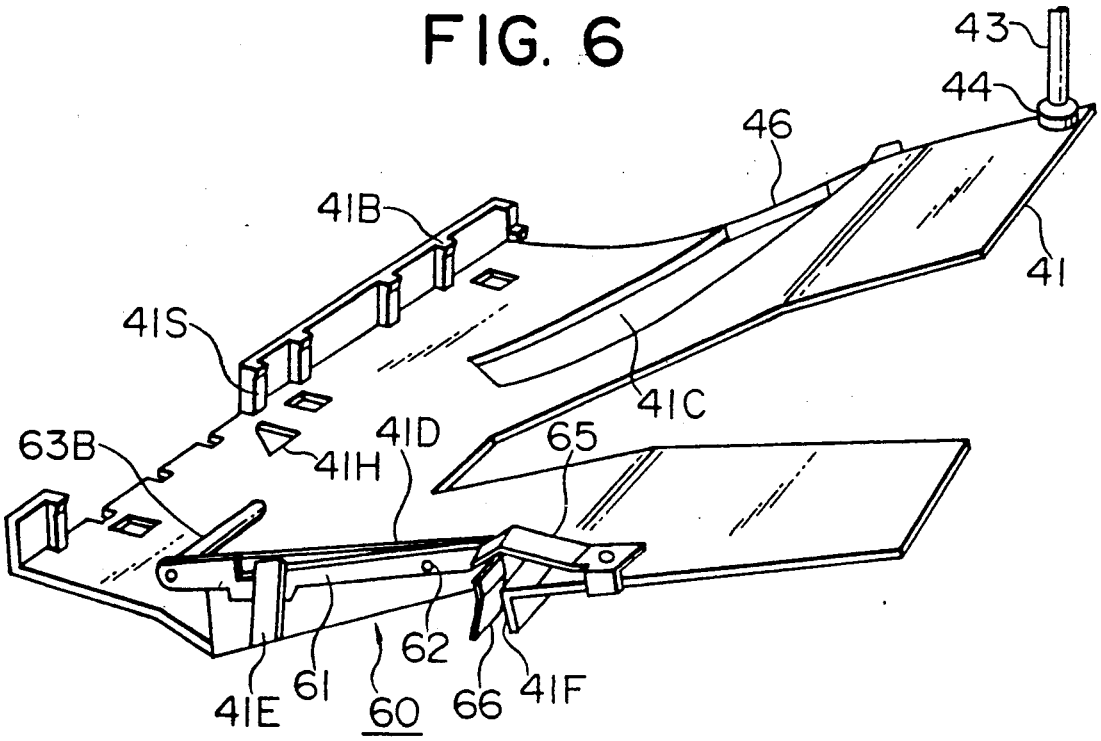
FIG. 6 is a perspective view of a bin to which the paper holding device is provided.

A vertical stopper wall 41D is integrally provided on the side of the aforementioned bin 41. A paper holding device 60 is mounted on the outer side of the aforementioned stopper wall 41D. FIG. 6 is a perspective view of the bin 41 to which the paper holding device 60 is provided. A lever 61 is supported by a shaft 62 mounted on the outer side surface of the stopper wall 41D in such a manner that the lever 61 can be freely oscillated. Numeral 41E is a guide portion to slidably guide the lever 61. A long and slender shaft 63A is mounted on the tip of the lever 61, and a pipe-shaped member 63B is provided around the shaft 63A with play. The other end of the aforementioned lever 61 is resiliently pressed by a leaf spring 65. A leaf spring 66 is supported and fixed in the manner of a cantilever at a bending portion located under a position where the lever 61 is pushed by the spring. The leaf spring 66 is pushed by a roller 72 mounted on the tip of the second arm 71B of a bin oscillating device 70.

Figure 7:
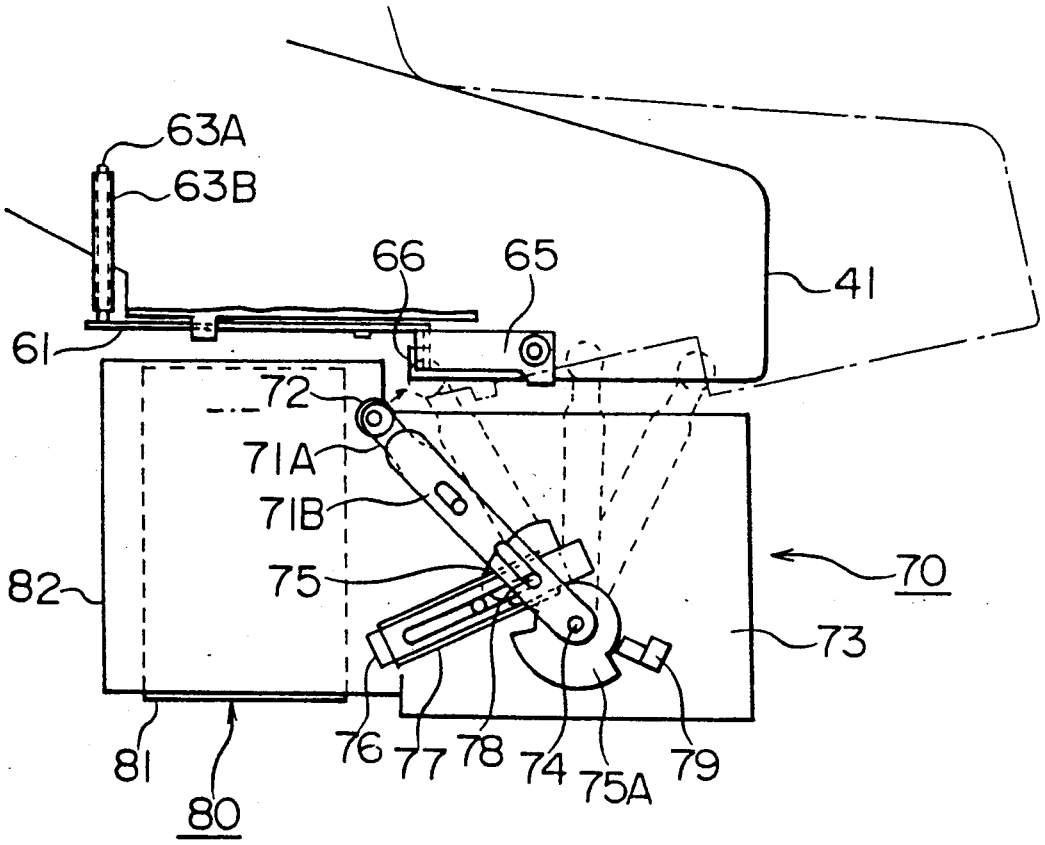
FIG. 7 is a plan view of a bin oscillating device.

FIG. 7 is a plan view of the bin oscillating device 70 which oscillates the aforementioned bin 41 and at the same time activates the aforementioned paper holding device 60.

The bin oscillating device 70 is mounted on a base plate 73. The first arm 71A is coaxially provided to a rotating shaft 74 which is driven by a motor and reduction gear train not illustrated in the drawing. The second arm 71B having long holes is provided to the first arm 71A in such a manner that it can be slid in the radial direction being pushed by a spring. A rubber coated roller 72 is mounted on the tip of the second arm 71B.

A cam plate 75 is provided to the aforementioned rotating shaft 74, and the cam plate 75 is composed of a U-shaped groove and an arc portion having the same radius.

On the other hand, a follower shaft 78 is supported being pushed by a spring, wherein the follower shaft 78 penetrates through a long groove portion of a moving member 77 which slides straight on a guide member 76 mounted on a portion of the base plate 73, the aforementioned first arm 71A, and the second arm 71B.

A semicircular shut-off plate 75A is integrally provided at the other end of the aforementioned cam plate 75, so that a photo-interrupter 79 is turned on and off.

When the aforementioned first arm 71A is rotated clockwise as shown by a broken line in FIG. 7, the follower shaft 78 moves the groove portion of the moving member 77 and at the same time moves the groove of the cam plate 75 to the outside. After the follower shaft 78 leaves the grooves, it slides on the curved surface of the arc portion having an equal radius. Before the aforementioned operation, the shielding plate 75A of the tail portion of the cam plate 75 interrupts the optical path of the photo-interrupter 79 so that the power source is turned off and the rotation of the motor is stopped. Consequently, even when there is an overrun after the motor has been stopped, the follower shaft 78 moves and stops on the arc portion having the equal radius of the cam plate 75, so that the first arm 71A maintains its stop position at a predetermined angle. Accordingly, the bin 41 stops at a predetermined position.

The base plate 73 of the aforementioned bin oscillating device 70 is mounted on the common frame 82 together with the base plate 81 of the stapling device. The base plate 73 moves vertically on the frame of the aforementioned bin shift section 40, and stops at each bin 41. Then, a bundle of papers stacked on the aforementioned oscillated bin 41 being held by the aforementioned paper holding device 63B, enter into a stapling gap of the stapling device to be stapled.

After the bundle of papers have been stapled, the second arm 71B is oscillated back so that the bin 41 is returned to the original paper discharging position being pushed by a spring.

Next, the stapling operation conducted on the bundle of papers discharged in the bin 41, will be explained as follows.

When the position of a document is determined on the platen glass of the copier 1, there are two manners, one is a manner in which the document is set so that the center of the document can coincide with the center line of the copier, and the other is a manner in which the document is set so that one side of the document can coincide with a reference line. The stapling operation conducted in the latter case will be explained here.

Figure 8:
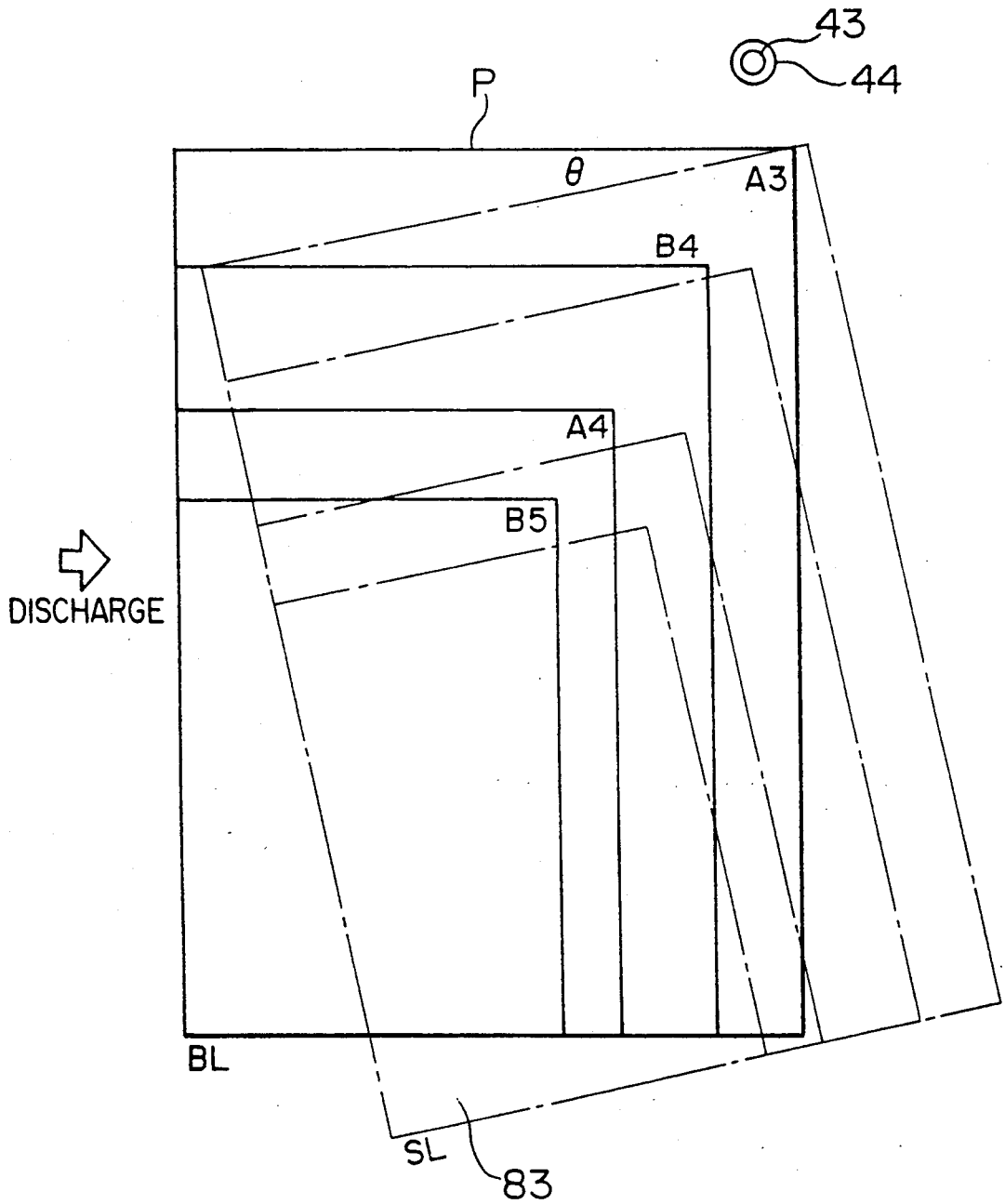
FIG. 8 is a plan view showing the progress of oscillation of various sizes of papers which are set in such a manner that the sides of the papers coincide with a reference line.

FIG. 8 is a plan view showing the progress of movement of paper P when the aforementioned bin 41 is oscillated.

(1) Papers P discharged from the copier 1 are pressed against the stopper wall 41D by an oscillating alignment rod 54 one by one so that the sides of papers P can be aligned along base line BL.

(2) When it is detected that a predetermined number of papers have been held in the bin 41, the second arm 71B of the aforementioned bin oscillating device 70 starts oscillation. The roller 72 mounted on the tip of the second arm 71B pushes the stopper wall 41F protruded to the lower side portion of the bin 41, through the spring 66 used for a buffer. Then, the lever 61 is oscillated against the force of the leaf spring 65, and the paper holding member 63B presses the bundle of papers from the upper side so that the slippage of papers can be prevented.

(3) When the aforementioned second arm is further oscillated, the bin 41 is oscillated around the slide member 44 while the papers are pressed in a manner described above, and the bin 41 reaches a position shown by a one-dotted chain line in FIG. 3. Then, the papers stacked on the bin 41 are oscillated to a position shown by a one-dotted chain line in FIG. 8 and stopped (a staple line SL).

(4) In this position, the leading edge portion of the papers is inserted into a gap formed in the stapling device 80, and a staple is hit into the papers to be stapled.

(5) After the stapling operation has been completed, the arm 71B is driven back to its initial position, and the bin 41 is returned to the original position by the force of a spring, and at the same time the paper holding member 62B is separated from the surface of the bundle of papers so that the bundle of papers can be taken out from the bin 41.

(6) After a stapling operation of the uppermost bin 41 has been completed, a common frame 82 in which the stapling device 80 and the bin oscillating device 70 are integrally formed, is lowered by a drive source, and then a bin 41 located below the uppermost bin is oscillated and a stapling operation is conducted in the same manner. While the aforementioned stapling operation is being conducted, papers stacked on a bin located below the aforementioned bin are discharged.

The stapling operation conducted in such a manner that the sides of papers are aligned along the stopper wall 41D (base line BL), is described above. Next, the stapling operation conducted in such a manner that the center of papers coincide with center line CL, will be explained as follows.

The first method is as follows:

Each of the papers discharged from the copier 1 is pushed by the aforementioned alignment rod 54 so that the paper can be bumped against the stopper wall 41D so as to be aligned in a position shown in FIG. 8. After that, the bin 41 is oscillated and stapled in the same manner as described before.

Although the drive structure of this method is simple, the displacement amount of a paper on the bin differs according to the paper size. Especially, in the case of a small-sized paper (for example, B5 size paper), the displacement amount on the bin 41 is large (which is W shown in the drawing), so that alignment can not be conducted positively.

The second method is as follows:

The entire bin movement section 40 including the bin 41 is moved forward in a direction perpendicular to the paper discharging direction in which the papers on the bin are trued corresponding to the paper size so that the papers are located at the same location as the one-sided.

Figure 9:
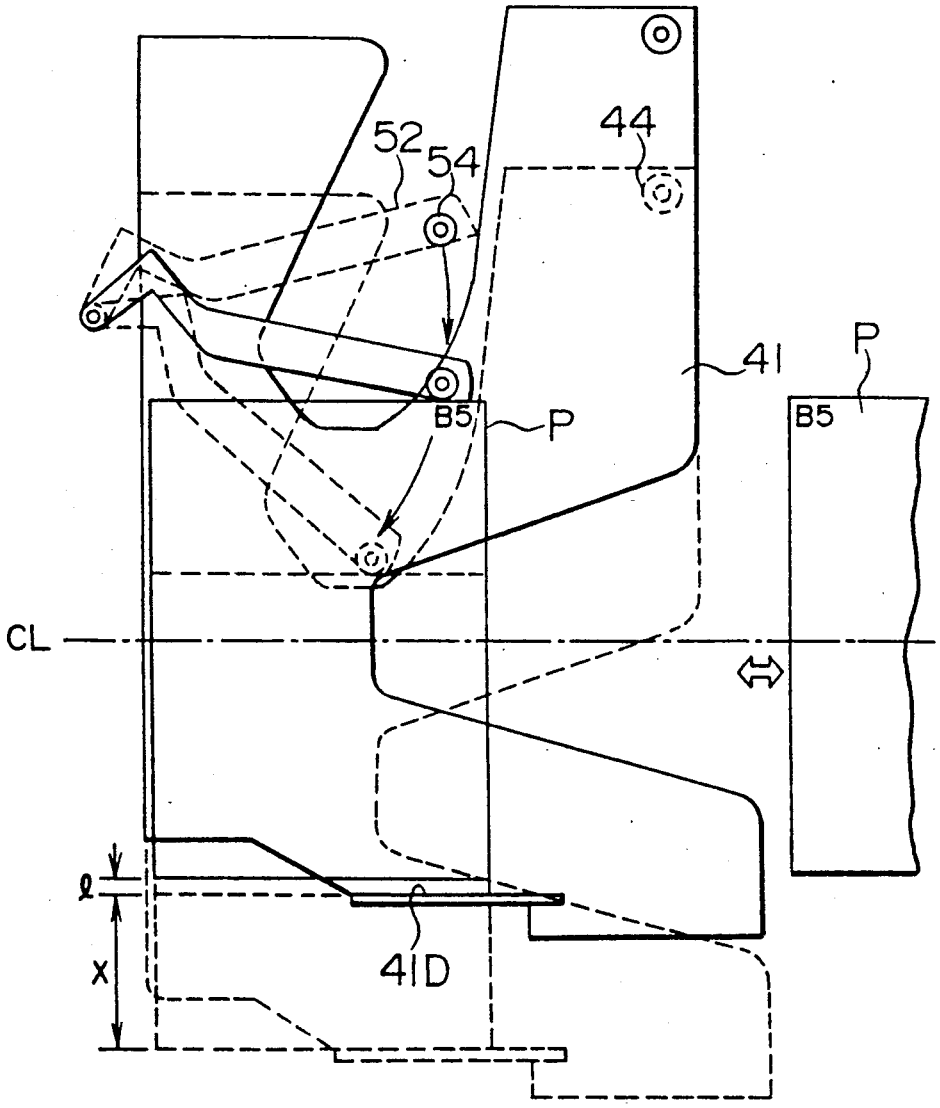
FIG. 9 is a plan view showing the straight motion of a bin.
Figure 10:
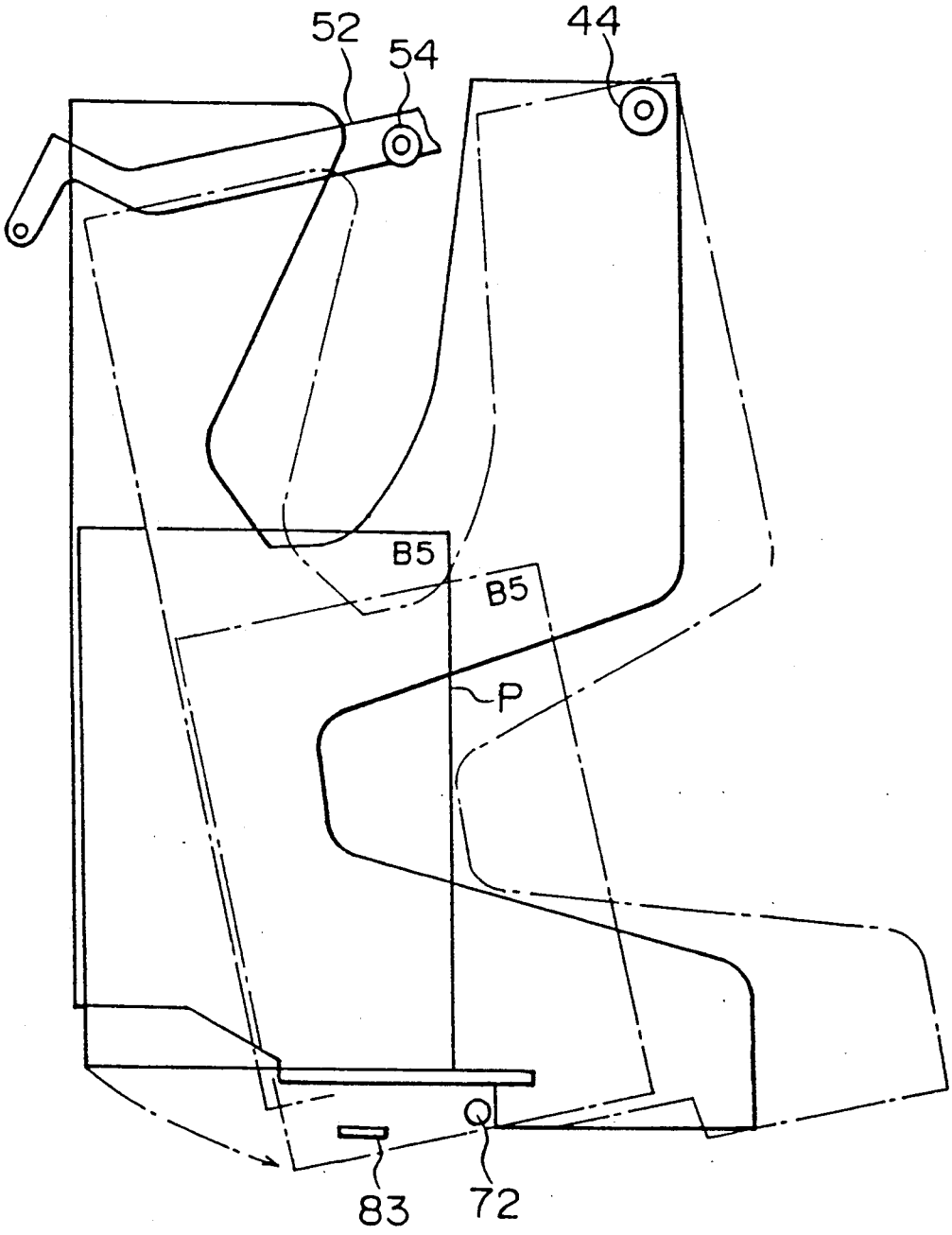
FIG. 10 is a plan view showing the progress of oscillation of a bin.
Figure 11:
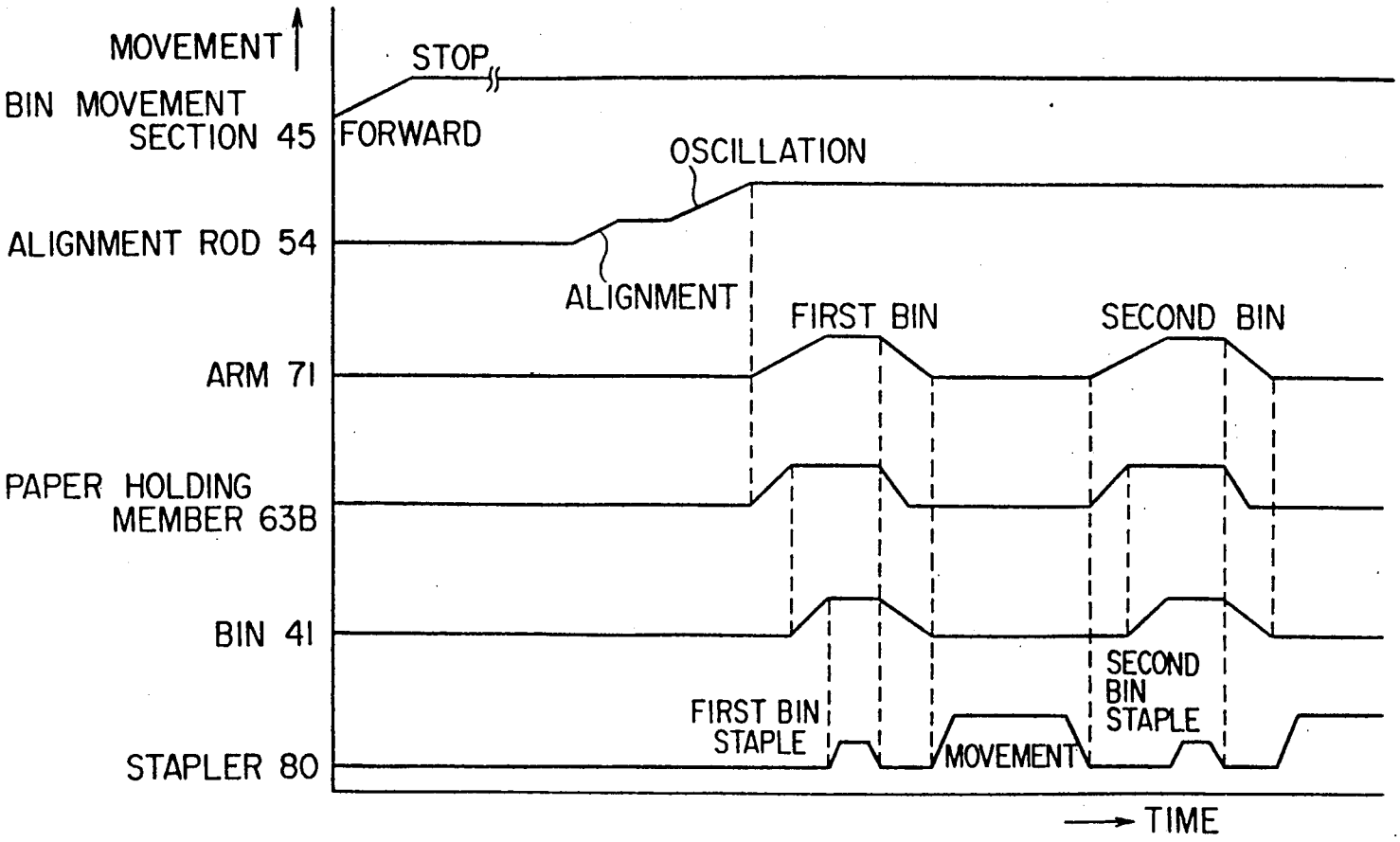
FIG. 11 is a timing chart of essential composing members of a sorter.

A stapling operation conducted according to this method is shown in the time charts of FIGS. 9, 10 and 11. This stapling operation will be explained as follows.

(1) After the size of paper (copy paper) discharged from the copier 1 is manually set or automatically judged, the bin moving section 40 of the sorter is electrically driven. When the sorter has come to a predetermined position corresponding to the aforementioned paper size, the movement of the sorter is stopped and the sorter is placed in a waiting condition. When the sorter is located in this waiting position, the stopper wall 41D of the bin 41 is located in a position separated from the side of paper P by 1 (for example, about 10 mm).

(2) Under the aforementioned condition, paper P advances from the left in the drawing, and rises along the inclined surface of the bin 41. After that, paper P slips down by its own weight and stops coming into contact with the front stopper 41B of the bin 41.

(3) After the movement of paper P has stopped, the alignment rod 54 is oscillated, and one side of paper P is pushed so that paper P is moved by the displacement amount 1 to this side, and the other side of paper P is contacted with the stopper wall D. This displacement amount 1 is set to almost the same value even in the case in which paper sizes are different (for example, A4 size, B4 size and A3 size).

(4) FIG. 10 is a plan view showing the progress of oscillation of a bin while a stapling operation is being conducted. When a stapling signal is inputted into the bin movement section 40 which is in a stopped condition, first the aforementioned bin oscillating device 70 is driven, and then the arm 71B is oscillated so that the roller 72 mounted on the tip of the arm 71B pushes the leaf spring 66 provided in the lower end of the aforementioned paper holding device 60. Further, the lever 61 is oscillated counterclockwise around the shaft 62 against the force of the upper leaf spring 65. Accordingly, the paper holding member 63B presses the upper surface of the sheets stacked on the bin 41.

(5) Successively, the roller 72 mounted on the tip of the arm 71B is oscillated around the slide member 44 (by the angle of about 12°), and oscillates the bin 41 while the sheets on the bin 41 is being pressed.

(6) When the follower shaft 78 of the bin oscillating device 70 has risen to a circular arc curved surface formed by the outer diameter of the cam plate 75, the driving of the bin 41 is stopped by a signal sent from the photo-sensor 79 which detects the position, or even when the rotation is continued by an inertia effect, the position of the roller 72 is not changed and the oscillation of the bin is stopped.

(7) Then, a staple 83 is hit in the same manner as described before.

(8) Next, the returning operation of the bin oscillating device 70 starts, and the bin 41 and the paper holding member 63B are returned to the initial positions.

(9) Successively, the second and third bin are oscillated in the same manner and a stapling operation is conducted.

As explained above, according to the first example of the present invention, the bins in which sheets are stacked, are oscillated for a stapling operation, and immediately before the oscillation of the bins, the bundles of sheets are pressed on the bins by the sheet pressing device which presses the sheets against the bin surface, so that slippage of sheets can be prevented. Consequently, the stapling positions can be easily stabilized in all the bins, so that the sheets can be positioned to a predetermined stapling position by a simple device, and a bundle of sheets can be positively stapled.

Especially when the aforementioned sheet holding device is provided on a sheet bumping surface (a stopper wall), the sheet alignment and stapling operation can be conducted in a constant position irrespective of the sheet size, and the stapling viscosity can be increased.

Figure 12:
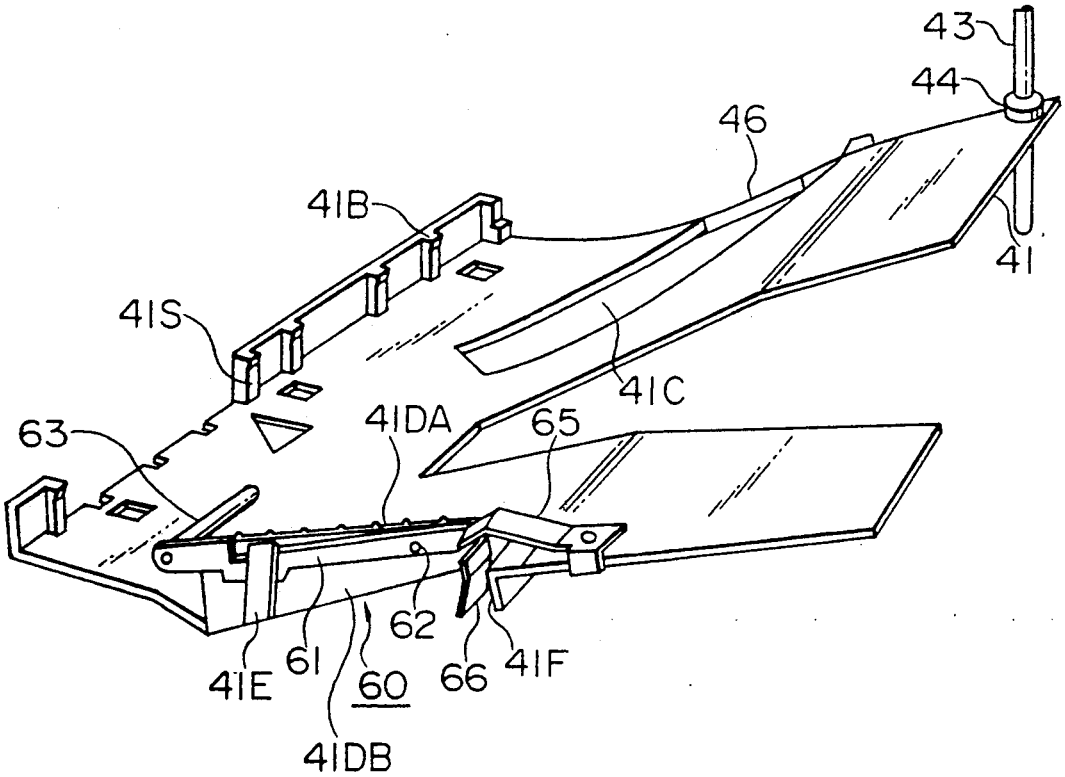
FIG. 12 is a perspective view of a bin provided with a paper pressing device.
Figure 13:
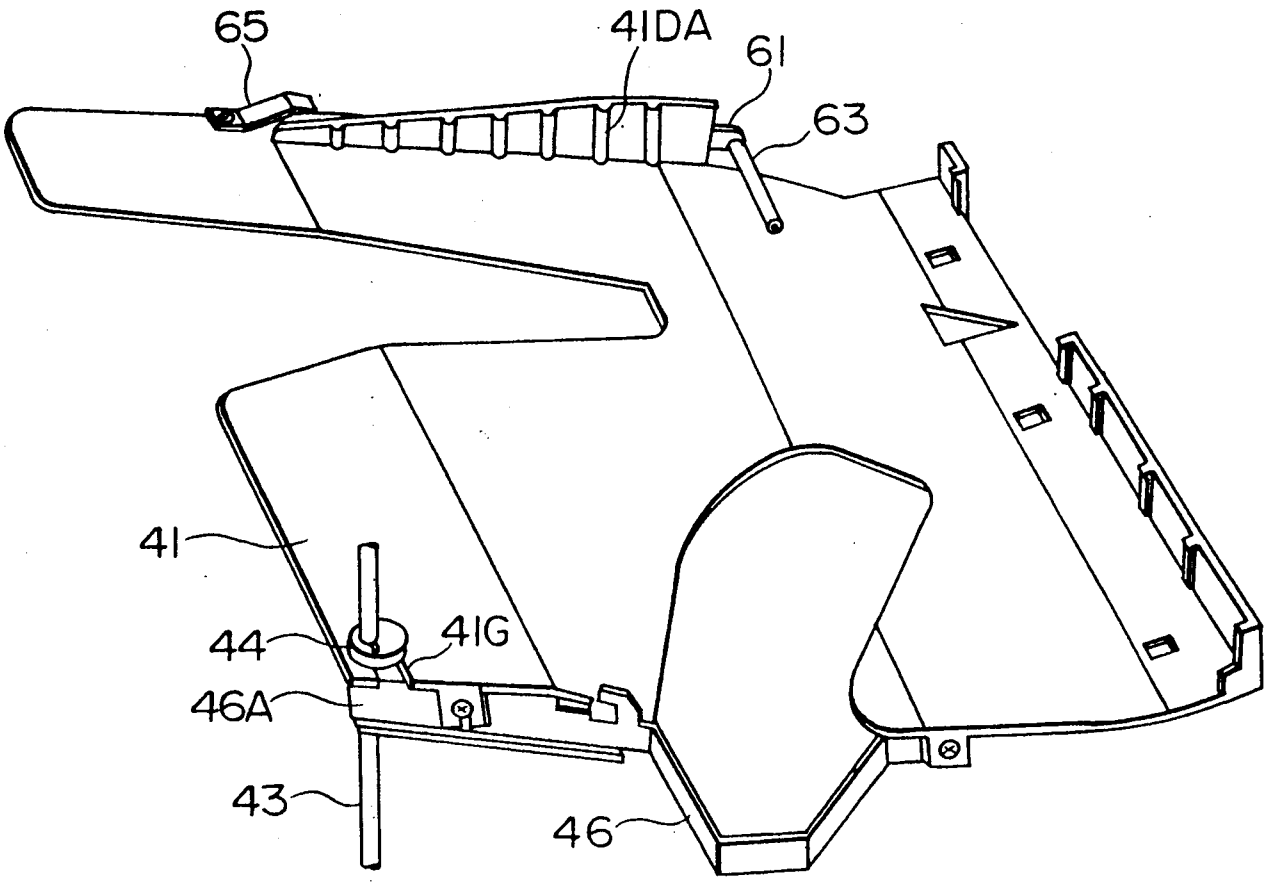
FIG. 13 is another perspective view of the aforementioned bin.

FIG. 12 and FIG. 13 are perspective views of the bin 41 provided with the paper holding device 60 according to the second example.

The vertical stopper wall 41D is integrally provided on one side of the aforementioned bin 41. The inner side wall 41DA of the stopper wall 41D is a bumping surface against which the side edge of paper P is bumped so that the paper can be aligned. The aforementioned bumping surface is formed into a step-like shape having a plurality of protrusions and cut-out portions. The aforementioned protrusions are contacted with one side edge of paper P, and the cut-out portions are separated from the aforementioned side edge so as to form a gap. The air of an air layer formed between the papers stacked by the oscillation of the aforementioned alignment rod 54, is released to the outside through the aforementioned gap, so that the following problem can be eliminated: the stack thickness of papers P is increased, so that the successive paper P runs over the bumping surface to the outside of the bin; and papers can not be aligned.

Figure 15:
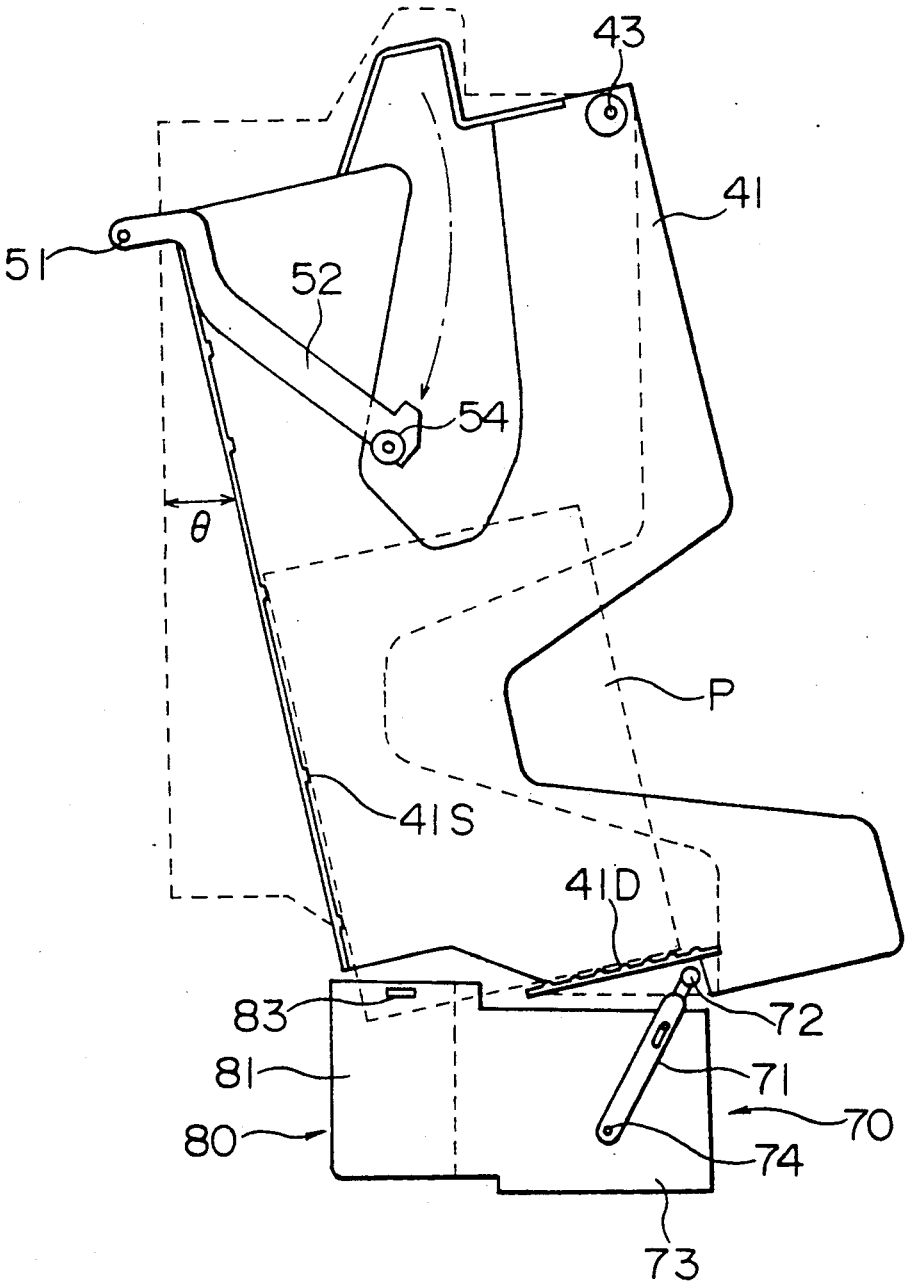
FIG. 15 is a plan view showing the progress of oscillation of the aforementioned bin.

The paper holding device 60 is provided on an outer side surface 41DB of the aforementioned stopper wall 41D. A lever 61 is rotatably provided to a shaft 62 which is fixed on to the outside surface 41DB of the stopper wall 41D. Numeral 41E is a guide which slidably guides the lever 61. A pipe-shaped paper holding member 63 is provided on one end of the lever 61. The other end of the lever 61 is resiliently pressed by a leaf spring 65. A leaf spring 66 is supported and fixed by a bent portion below the pressed portion of the leaf spring 66 in a manner of a cantilever. The leaf spring 66 is pushed by a roller 72 mounted on a tip of an arm 70 of a bin oscillating device 70 as shown in FIG. 15. The arm 71 is oscillated by a rotating shaft 74 which is driven by a motor not shown through a reduction gear train, and pushed by a spring so that it can be slid in a longitudinal direction of the arm.

A base plate 73 of the aforementioned bin oscillating device 70 is mounted on a common frame together with a base plate 81 of the stapler 80. The base plate 73 of the bin oscillating device is moved and stopped at each bin 41 by a lift not shown which is driven on the frame of the aforementioned bin moving section 40 in the up and down direction. Due to the foregoing, a bundle of papers which are stacked on the oscillated bin 41 being pressed by the aforementioned paper holding member 63, enter into a stapling gap of the stapler 80 so that a staple can be hit into the bundle of papers.

After the staple has been hit, the arm 71 is returned and oscillated, and the bin 41 is pushed by the spring, oscillated, and returned to the initial paper discharging position.

Next, a stapling operation of a bundle of papers discharged onto the bin 41 will be explained as follows.

When the position of a document is determined on the platen glass of the image forming apparatus 1, there are two manners, one is a manner in which the document is set so that the center of the document can coincide with the center line of the image forming apparatus, and the other is a manner in which the document is set so that one side of the document can coincide with a reference line.

Figure 14:
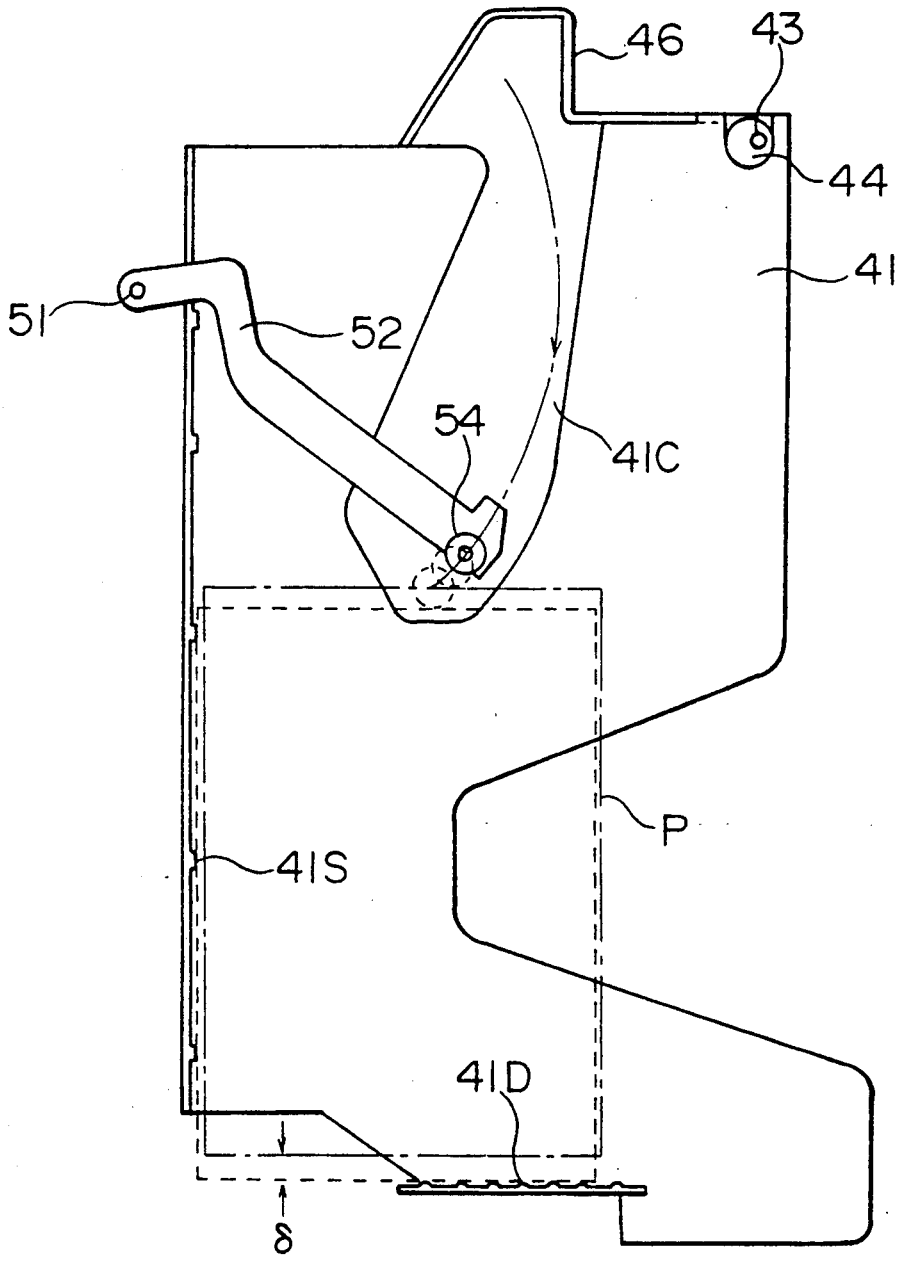
FIG. 14 is a plan view showing straight movement of the aforementioned bin.

Referring now to FIG. 14 and FIG. 15, a stapling operation conducted in the former manner will be explained here. FIG. 14 is a plan view showing a state of accommodation and alignment of papers on the bin 41, and FIG. 15 is a plan view showing a state in which the bin 41 is oscillated and stapled.

(1) When the size of a paper P (a copy paper) discharged from the image forming apparatus 1 is set manually or automatically, the bin shift section 40 of the sorter is driven electrically, and when the bin has reached a predetermined position corresponding to the size of the aforementioned paper, the bin stops according to a signal sent from a position detecting sensor. Therefore, the bin is set in a waiting condition. The maximum movement amount of the bin movement section 40 is determined in such a manner that: the minimum width of paper (for example, B5 size, 257 mm) is subtracted from the maximum width of paper (for example, 17 inches); and the obtained value is divided by 2 (for example, 87.4 mm can be obtained). In this waiting position, the stopper wall 41D of the bin 41 is located in a position which is separated from a side edge of the width direction of paper P by distance $\delta$ (for example 10 mm).

(2) In the aforementioned condition paper P enters from the left in the drawing, and moves upward along the inclined surface of the uppermost bin 41. After that, paper P slides down by its dead weight and bumps against a front stopper 41S to be stopped.

(3) After paper P has been stopped, the alignment rod 54 is oscillated and pushes one side edge of paper P to move it toward the viewer's side by the distance of $\delta$, so that the other side edge of paper P can be contacted with the stopper wall 41D. This distance $\delta$ is set to almost the same in the case of other sizes (for example, A4 size, B4 size and A3 size).

(4) Successively, the following paper P is discharged into the second bin 41 by the branch guide 36, and the aforementioned alignment rod 54 is oscillated and pushes the side edge of paper P in the same manner as described above, so that paper P is contacted with the stopper wall 41D to be aligned.

(5) In the same manner as described above, papers are successively stacked in the bins, the number of which corresponds to that of document sheets.

(6) When a counter of CPU control detects that a predetermined number of papers P have been accommodated in the uppermost 41, and when it is detected that an optical path has been opened which is formed between a light emitting element LED provided to the upper portion of the bin movement section 40 and a light receiving element $PT_r$ provided to the lower portion so as to detect the passing of the trailing end of a final paper P, the discharging operation to the first bin 41 is completed. (Refer to FIG. 1.)

(7) Immediately after it is detected that a paper discharging operation to the second bin 41 has been completed, or after a predetermined period of time has passed after the detection, the aforementioned uppermost bin 41 is oscillated by the aforementioned bin oscillating device 70. When a stapling signal is inputted into the stopped bin movement section 40, the paper holding member 63 presses the upper surface of the sheets stacked on the bin 41 in such a manner that: first, the aforementioned bin oscillating device 70 is driven and the arm 71 is oscillated; the roller 72 mounted on the tip pushes the leaf spring 66 provided to the lower end of the aforementioned paper holding device 60; and further the roller 72 oscillates the lever 61 counterclockwise around the shaft 62, resisting the force of the leaf spring 65.

(8) Successively, the roller 72 mounted on the tip of the arm 71, is oscillated around the slide member 44 (for example, $\theta = 12°$) so that the bin 41 is oscillated while the sheets in the bin 41 are being pressed.

(9) A sensor of the bin oscillating device 70 detects the oscillating position and the oscillation of the bin 41 is stopped.

(10) In this stop position, a rear corner portion of the bundle of papers is inserted into a stapling gap of the stapler 80, and then the stapler 80 is driven and a staple 83 is hit.

(11) After the stapling operation has been completed, the arm 71 is driven to be returned, so that the bin 41 is pushed by a spring force and returned to the initial position, and at the same time the paper holding member 63 is separated upward from the surface of the bundle of papers. In this manner, the bundle of papers 41 can be taken out from the bin 41.

(12) After the bundle of papers accommodated in the uppermost bin 41 have been stapled, a unit in which the stapler 80 and oscillating device 70 are integrally provided, is lowered by a lift, and almost simultaneously the bin 41 positioned below the uppermost bin is oscillated and a stapling operation is conducted in the same manner. In the mean time, a paper discharging operation is conducted in a bin 41 located further below.

(13) When all the bundles of paper have been stapled, the unit in which the bin oscillating device and stapler have been integrated, is returned to the uppermost bin position.

The aforementioned stapling operation has been conducted on a sorter in which papers are aligned under the condition that a center of the paper discharged from the image forming apparatus 1 coincides with the center line of the apparatus 1. However, it should be understood that the present invention is not limited to the specific embodiment. The present invention can be applied to a sorter in which paper alignment is conducted so that one side of a paper can coincide with a reference line.

As explained above, the second embodiment of the present invention is characterized in that: a notch portion is provided to each bin; the shape of the notch is formed in such a manner that the aforementioned alignment member can be inserted into the notch from the outside when the bin is moved and the alignment operation is conducted; a portion close to the opening of the notch is fixed by a reinforcement member; and a bearing member which rotatably holds the bin, is positioned and fixed by the arm of the aforementioned reinforcement member. Therefore, assembly of the bin and alignment device and maintenance such as replacement of parts can be easily performed, and the size and weight of the bin can be reduced.

Next, the third embodiment of the present invention will be explained as follows.

Figure 16:
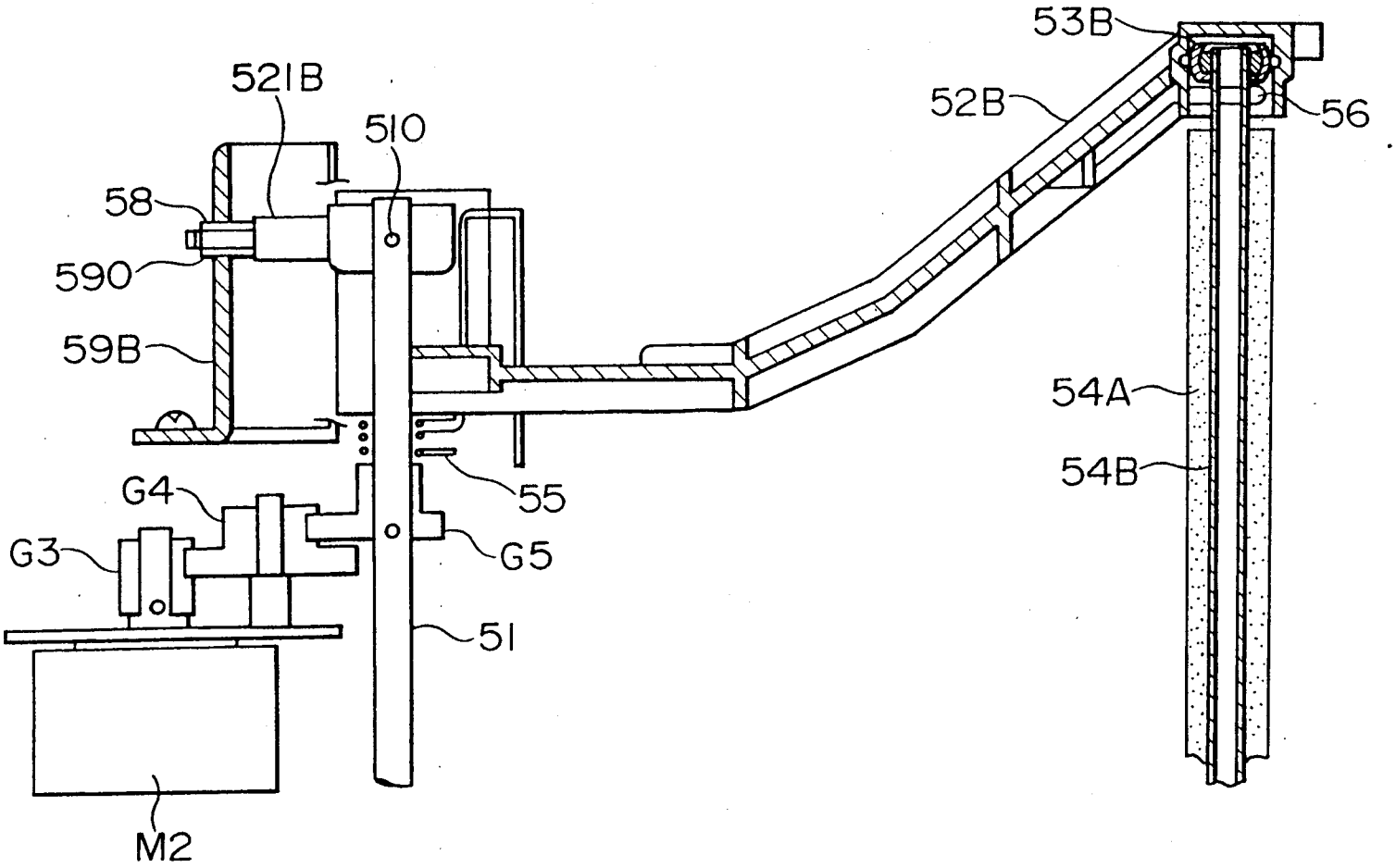
FIG. 16 is a sectional view of an upper portion of the alignment device of the third embodiment.

The alignment device 50 is vertically supported by the upper and lower portion of the aforementioned frame. The alignment rod 54 is supported and oscillated by the upper arm 52B and the lower arm 52A which can be oscillated engaging with the rotating shaft 51, wherein the rotating shaft 51 is rotated by pulse motor M2 through a transmission system including gears G3, G4, G5 as shown in FIG. 16. Numeral 55 is a return spring which pushes the upper arm 52B wound around the rotating shaft 51. The tip portion of the upper arm 52B holds an upper end of the core bar 54A of the alignment rod 54 through the aligning bearing 53B. A lower end of the core bar 54A of the aforementioned alignment rod 54 is engaged with the aligning bearing 53A provided at the end of the lower arm 52A.

The core bar 54A of the alignment rod 54 is made of a light hollow cylindrical core bar, the outside diameter of which is about 8 mm. For example, a pipe made of a light metal such as aluminum, or a pipe made of a light fiber reinforced plastic is utilized for the core bar 54A. The outer circumference of the core bar 54A is coated with a resilient member 54B made of a foam resin such as sponge, the thickness of which is about 5 mm. The alignment rod 54 composed of the core bar 52A and the resilient member 54B, is light, so that the inertia of the aforementioned arms 52A, 52B can be reduced when they are oscillated.

Leaf springs 56 are respectively provided to the tip portions of the aforementioned upper arm 52*b* and lower arm 52A. The tip portions of the leaf springs 56 push the ends of the core bars 54B, 54A of the alignment rod 54. When sheets are aligned, the alignment rod 54 is oscillated by the arms 52B, 52A. When the alignment rod 54 reaches the side edge of sheets, it pushes the sheet edge by the force of the leaf spring 56 and the resilience of the resilient members 54B, 54A.

The aforementioned resilient member 54B comes into contact with the side of paper P discharged onto the bin with light pressure so that paper P can be pushed against the stopper wall 42D provided on the side of the bin 41 in order to align paper P. In the aforementioned aligning operation, the arms 52A, 52*b* slightly overrun the paper width, for example, it overruns by 2 −3 mm so that alignment of paper P can be positively performed. In this case, one side edge of paper P is contacted with the stopper wall 41D, and the other side edge is lightly contacted with the aforementioned soft resilient member 54B. Therefore, the side edge of paper P is not damaged.

When a paper is accommodated into the bin 41 in such a manner that it is conveyed onto a paper previously accommodated in the bin 41, and aligned by the aforementioned alignment rod 54, the alignment rod 54 hits the side edge of the bundle of papers in order to align them. In this time, the impact given by the alignment rod 54 can be absorbed and reduced since the aforementioned leaf spring 56 and resilient member 54B function as a buffer. Therefore, pulse motor M2 is not given an over load, and it never steps out.

An arc-shaped curved surface 520 protrudes from the aforementioned upper arm 52B, and intercepts an optical path of a photo-interrupter (a transmission type of photo-sensor), so that the home position of the upper arm 52B can be detected.

The oscillating angle of the aforementioned upper arm 52B is changed according the number of setting pulses of the aforementioned pulse motor M2 so that paper alignment can be conducted correspondingly to the size of discharged paper P.

A protruded shaft 521B is fixed to an oscillating base portion of the aforementioned upper arm 52B, and the upper arm 52B can be vertically oscillated around a pin 510 mounted on the rotating shaft 51. A roller 58 is rotatably engaged with the tip portion of the aforementioned protruded shaft 521B. The roller 58 slidably comes into contact with a groove cam 590 of a cam member 59B which is fixed to the aforementioned frame. Accordingly, when the upper arm 52B is oscillated around the rotating shaft 51, the roller 58 is also oscillated in the axial direction, slidably coming into contact with the aforementioned groove cam 590. In the same manner, the roller 58 is rotatably engaged with a protruded shaft 521A which is protruded into the oscillating base portion of the lower arm 52A, and the roller 58 is slidably contacted with the groove cam 590 of the cam member 59A and oscillated in the axial direction. When sheets P tacked on the bin 42 are aligned by the aforementioned oscillating motion, the side edges of the papers are pressed downward to be aligned.

Figure 17:
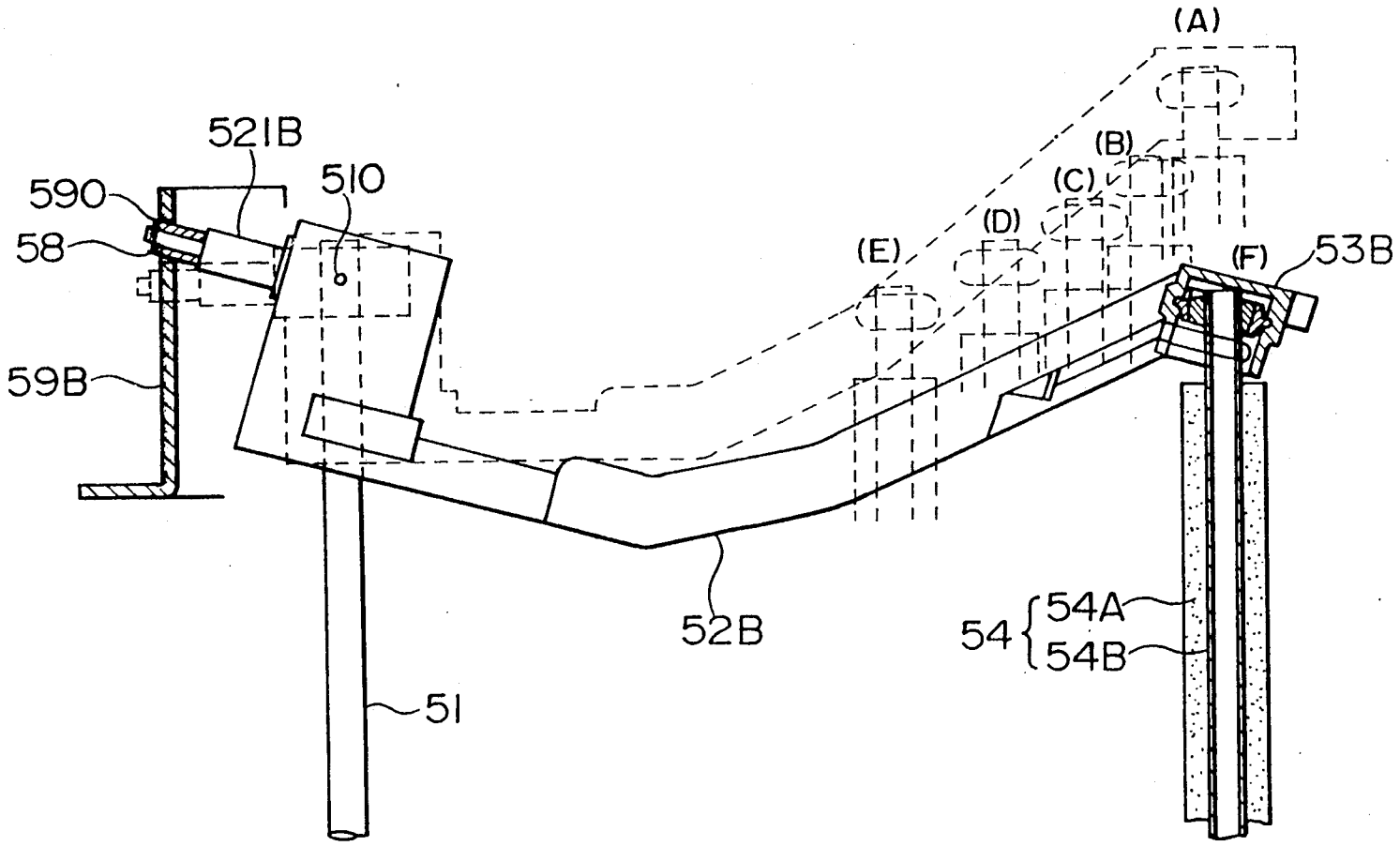
FIG. 17 is a front sectional view showing the progress of oscillation of an arm and alignment rod of the bin alignment device of the third embodiment.

FIG. 17 is a sectional view showing an oscillating state of the alignment rod 54.

In FIG. 17, the shape illustrated by a broken line shows a progress in which initial position A of the alignment rod 54 moves to final position F through intermediate positions B–E.

The aforementioned alignment rod 54 moves along an oscillating locus (illustrated by a one-dotted chain line) show in the plan view of FIG. 15, and at the same time moves along a three-dimensional locus composed of a horizontal and vertical locus, so that sheets P on the bin 41 are pressed downward to be aligned.

On the other hand, the bin 41 is oscillated as shown by a one-dotted chain line in FIG. 5 in order to insert papers P stacked on the bin 41 into the stapler. At the same time, all the bins 41 are moved forward and backward together with the bin moving section 40 by motor M1 correspondingly to the paper size. Accordingly, a large opening portion 41C is formed in the bin 41 as shown in FIG. 5 so that the alignment rod 54 can not interfere with the bin 41. Numeral 46 is a reinforcement member which closes the opening 41C of the bin 41 in order to prevent deformation of the bin 41 caused by the large opening 41C. This reinforcement member 46 is screwed to a side of the bin 41. At the same time, an arm 46A of the reinforcement member 46 closes a cut-out portion (a U-shaped groove) 41G through which the aforementioned slide member 44 is inserted, in order to prevent disconnection of the slide member 44 so that the slide member 44 can be positioned and fixed.

The vertical stopper wall 41D is integrally provided on one side of the aforementioned bin 41. An inner side surface of the stopper wall 41 is a bumping surface against which a side edge of paper P is bumped in order to align the paper. The bumping surface is formed into a step-shape having a plurality of protruded and cut-out portions. The protruded portions are contacted with one of the side edges of paper P, and the cut-out portions are separated from the aforementioned side edge of paper P so as to form gaps. Air in an air layer formed between papers in a bundle of papers stacked on the bin 41 by the oscillation of the aforementioned alignment rod 54, leaks to the outside through the aforementioned gaps formed by the cut-out portions. Accordingly, the following problem can be solved: the height of the stack of papers P on the bin 41 is increased, and successive paper P runs over the bumping surface and jumps out of the bin to cause a failure in paper alignment.

A paper holding device 60 is provided on an outer side of the aforementioned stopper wall 41D. A lever 61 is rotatably supported by a shaft 62 provided on the outer surface of the stopper wall 41D. A paper holding member 63 is provided at one of the ends of the lever 61.

The other end of the lever 61 is pressed by a roller 72 which is pushed by a leaf spring and mounted on the tip of an arm 71 of a bin oscillating device 70. Since the lever 61 is pushed in the manner mentioned above, it is oscillated so as to press the upper surface of papers P stacked on the bin 41.

A base plate of the aforementioned bin oscillating device 70 is mounted on a common frame together with a base plate of a stapler 80. The base plate is moved and stopped at each bin by a lift not shown which is driven in the up and down direction on the aforementioned bin moving device 40, and the bundle of papers stacked on the bin 41, being pressed by the aforementioned paper holding member 63, are inserted into a stapling gap of the stapler 80 so that a staple 83 can be hit.

After the staple has been hit, the arm 71 is returned and the bin 41 is oscillated by a spring force and returned to the initial paper discharging position.

Next, a stapling operation conducted on a bundle of papers discharged onto the bin 41 will be explained as follows.

When the position of a document is determined on the platen glass of the image forming apparatus 1, there are two manners, one is a manner in which the document is set so that the center of the document can coincide with the center line of the image forming apparatus, and the other is a manner in which the document is set so that one side of the document can coincide with a reference line.

Figure 18:
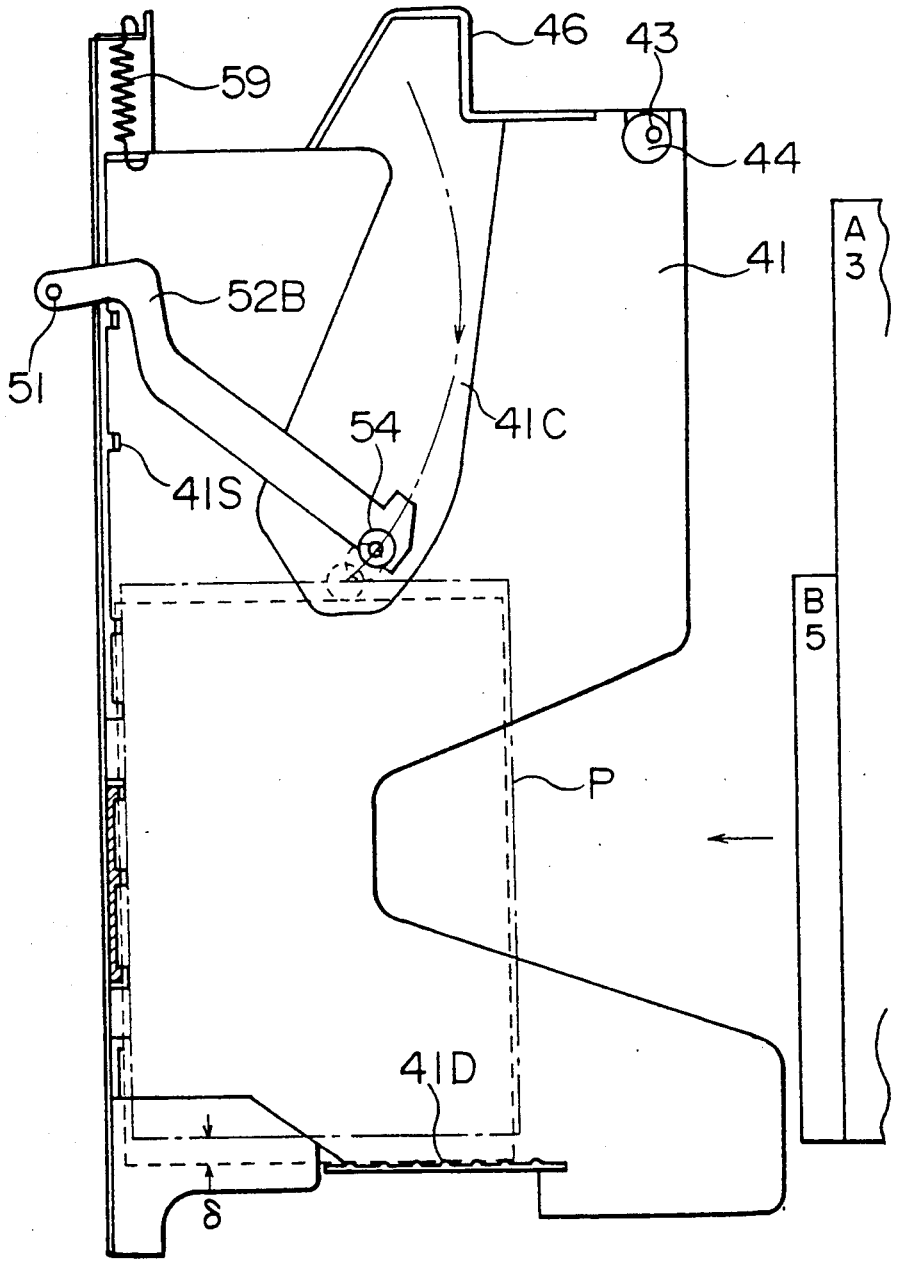
FIG. 18 is a plan view showing the straight movement of the aforementioned bin.
Figure 19:
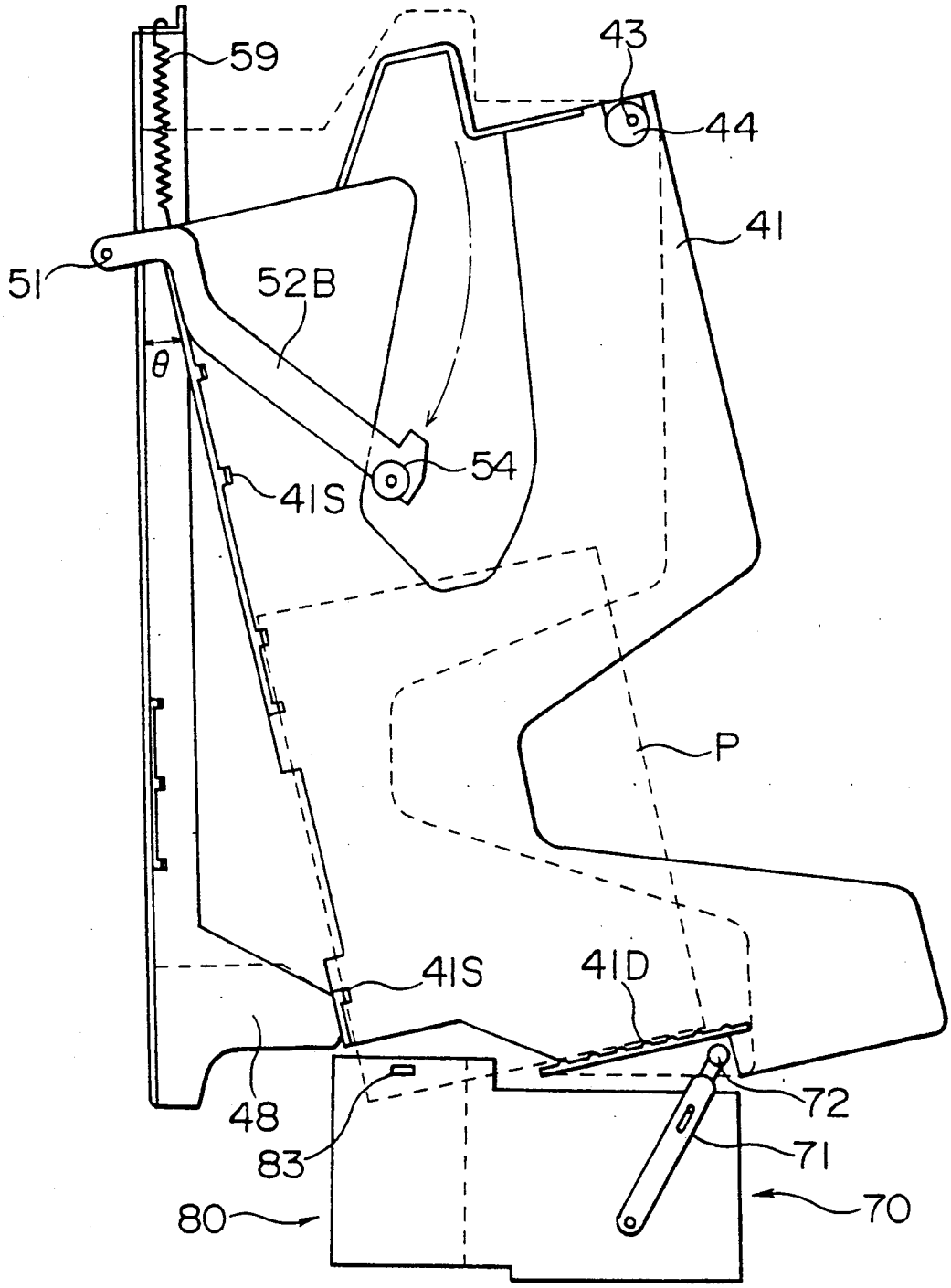
FIG. 19 is a plan view showing the progress of oscillation of the aforementioned bin.

A stapling operation of a bundle of papers P which are discharged on the center line, will be explained referring to FIG. 18 and FIG. 19. FIG. 18 is a plan view showing a state of accommodation and alignment of papers performed on the bin 41. FIG. 19 is a plan view showing a state of a stapling operation performed while the bin 41 is oscillated.

(1) When the size of a paper P (a copy paper) discharged from the image forming apparatus 1 is set manually or automatically, the bin shift section 40 of the sorter is driven electrically, and when the bin has reached a predetermined position corresponding to the size of the aforementioned paper, the bin stops according to a signal sent from a position detecting sensor. Therefore, the bin is set in a waiting condition. The maximum movement amount of the bin movement section 40 is determined in such a manner that: the minimum width of paper (for example, B5 size, 257 mm) is subtracted from the maximum width of paper (for example, 17 inches); and the obtained value is divided by 2 (for example, 87.4 mm can be obtained). In this waiting position, the stopper wall 41D of the bin 41 is located in a position which is separated from a side edge of the width direction of paper P by distance $\delta$ (for example 10 mm).

(2) In the aforementioned condition paper P enters from the left in the drawing, and moves upward along the inclined surface of the uppermost bin 41. After that, paper P slides down by its dead weight and bumps against a front stopper 41S to be stopped.

(3) After paper P has been stopped, the alignment rod 54 is oscillated and pushes one side edge of paper P to move it toward the viewer's side by the distance of $\delta$, so that the other side edge of paper P can be contacted with the stopper wall 41D. This distance $\delta$ is set to almost the same in the case of other sizes (for example, A4 size, B4 size and A3 size).

(4) Successively, the following paper P is discharged into the second bin 41 by the branch guide 36, and the aforementioned alignment rod 54 is oscillated and pushes the side edge of paper P in the same manner as described above, so that paper P is contacted with the stopper wall 41D to be aligned.

(5) In the same manner as described above, papers are successively stacked in the bins, the number of which corresponds to that of document sheets.

(6) When a counter of CPU control detects that a predetermined number of papers P have been accommodated in the uppermost 41, and when it is detected that an optical path has been opened which is formed between a light emitting element LED provided to the upper portion of the bin movement section 40 and a light receiving element $PT_r$ provided to the lower portion so as to detect the passing of the trailing end of a final paper P, the discharging operation to the first bin 41 is completed. (Refer to FIG. 1.)

(7) Immediately after it is detected that a paper discharging operation of the second bin 41 has been completed, or after a predetermined period of time has passed after the detection, the aforementioned uppermost bin 41 is oscillated by the aforementioned bin oscillating device 70, resisting a force of the spring 59. When a stapling signal is inputted into the stopped bin moving section 40, the paper holding member 63 presses the upper surface of the sheets stacked on the bin 41 in such a manner that: first, the aforementioned bin oscillating device 70 is driven and the arm 71 is oscillated; the roller 72 mounted on the tip pushes the aforementioned paper holding device 60; and further the roller 72 oscillates the lever 61 counterclockwise around the shaft 62.

(8) Successively, the roller 72 mounted on the tip of the arm 71, is oscillated around the slide member 44 (for example, $\theta = 12°$) so that the bin 41 is oscillated while the sheets in the bin 41 are being pressed.

(9) A sensor of the bin oscillating device 70 detects the oscillating position and the oscillation of the bin 41 is stopped.

(10) In this stop position, a rear corner portion of the bundle of papers is inserted into a stapling gap of the stapler 80, and then the stapler 80 is driven and a staple 83 is hit.

(11) After the stapling operation has been completed, the arm 71 is driven to be returned, so that the bin 41 is pushed by a spring force and returned to the initial position, and at the same time the paper holding member 63 is separated upward from the surface of the bundle of papers. In this manner, the bundle of papers 41 can be taken out from the bin 41.

(12) After the bundle of papers accommodated in the uppermost bin 41 have been stapled, a unit in which the stapler 80 and oscillating device 70 are integrally provided, is lowered by a lift, and almost simultaneously the bin 41 positioned below the uppermost bin is oscillated and a stapling operation is conducted in the same manner. In the mean time, a paper discharging operation is conducted in a bin 41 located further below, and the alignment rod is oscillated to align the sides of papers P.

(13) When all the bundles of papers have been stapled, the unit in which the bin oscillating device and stapler have been integrated, is returned to the uppermost bin position.

The aforementioned stapling operation has been conducted on a sorter in which papers are aligned under the condition that a center of the paper discharged from the image forming apparatus 1 coincides with the center line of the apparatus 1. However, it should be understood that the present invention is not limited to the specific embodiment. The present invention can be applied to a sorted in which paper alignment is conducted so that one side of a paper can coincide with a reference line.

As explained above, according to third embodiment of the present invention, the sheets accommodated on the bin are aligned in such a manner that the side edges of the sheets are pressed downward by the alignment rod which is oscillated in a manner of three dimensions. Therefore, even when curled papers can be positively pressed onto the reference wall surface, so that the sides of sheets can be orderly aligned, and the following stapling operations can be positively conducted. When sheets are aligned, the aforementioned alignment rod being pushed by the spring, presses the side edges of the bundle of papers, so that an impact load is not given to the pulse motor and the stepping out of the pulse motor can be avoided. Consequently, oscillation can be performed smoothly, and driving force can be effectively reduced.

In the case of a sorter in which a non-sort bin, which is also used for a paper discharging tray, is mounted on the uppermost portion of a plurality of bins, the sides of papers are aligned while the aforementioned alignment rod and supporting arm are being lowered. Accordingly, the alignment rod and supporting arm do not interfere and contact with the non-sort bin which are disposed in a small space, so that the total height of the sorter can be reduced and the apparatus can be made compact.

Referring to the drawings, the fourth embodiment to accomplish the second object of the present invention will be explained as follows.

Figure 20:
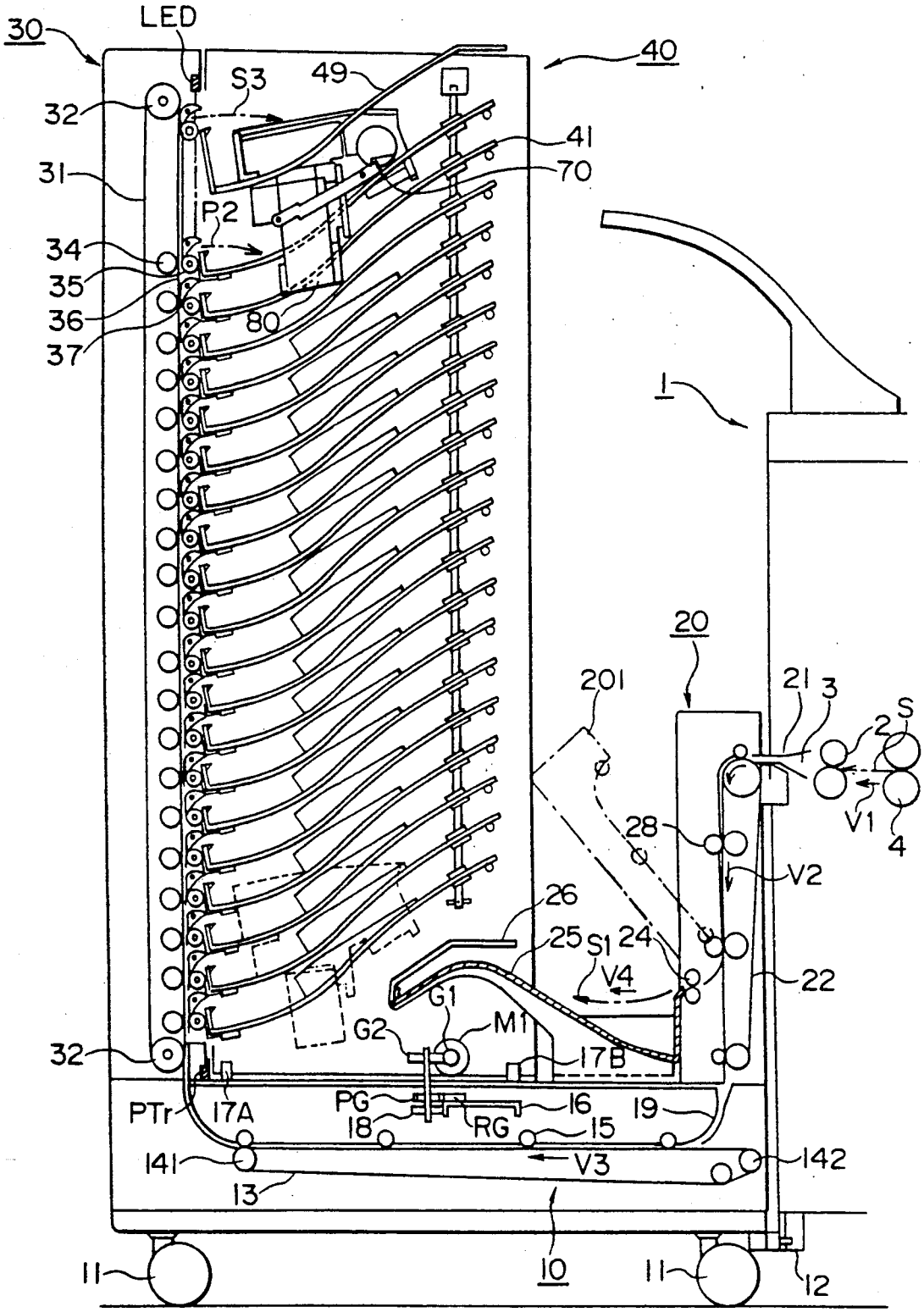
FIG. 20 is a view showing the structure of a sorter connected with the image forming apparatus of the fourth embodiment to achieve the second object of the present invention.
Figure 21:
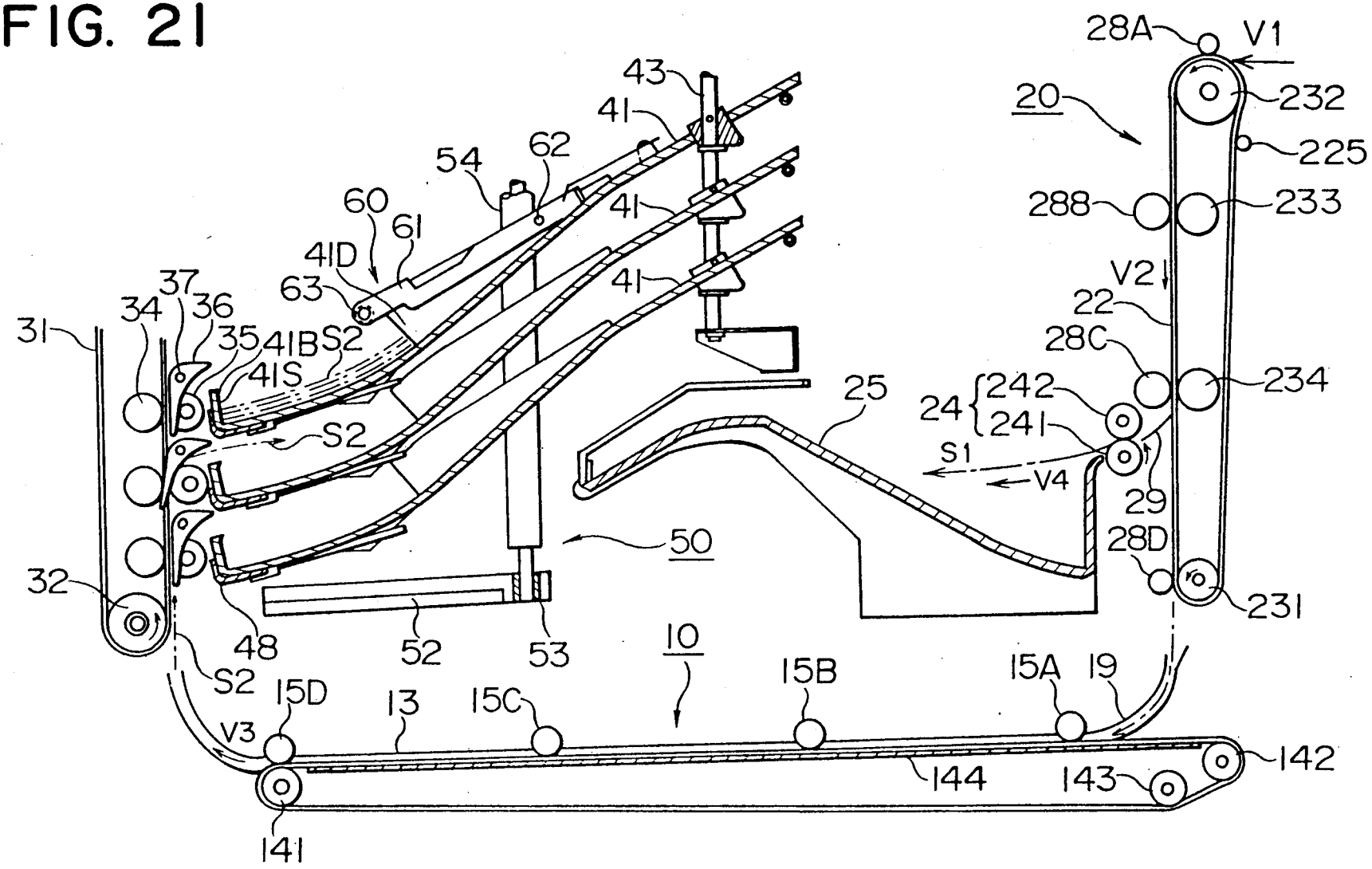
FIG. 21 is a sectional view showing an essential portion of the sheet conveyance system of the aforementioned sorter.

FIG. 20 is a view showing the structure of a sorter connected with the image forming apparatus (for example, a copier) 1. FIG. 21 is a sectional view showing an essential portion of a sheet conveyance system. A sorter of the present invention is composed of a base 10, downward conveyance section 20, upward conveyance section 30, and bin moving section 40.

The base 10 comprises a caster 11, a connecting means 12 to connect with the image forming apparatus 1, a conveyance belt 13, conveyance rollers 14 composed of a drive roller 141, an idle roller 142 and a tension roller 143, pushing rollers 15A, 15B, 15C, 15D, a guide plate 19, and a drive means which will be described later, and the like. The base 10 is fixed on the floor.

A stay member 16 is fixed to the base (the intermediate conveyance section) 10 in a direction perpendicular to the surface of FIG. 20. Rack gear RG is fixed on the upper surface side of the stay member 16.

A stay member 16 is provided to the base frame (the horizontal conveyance section) 10 in the direction perpendicular to the surface of FIG. 1. A rack gear RG is fixed on the upper surface of the stay member 16.

On the other hand, rollers 17A, 17B used to move the frame are rotatably provided in the frame of the bin shift section 40. The aforementioned rollers 17A, 17B move on rails of the aforementioned base frame 10, wherein the rails are not illustrated in the drawing. Therefore, the frame of the bin shift section 10 can be moved in the direction perpendicular to the surface of the drawing. Motor M1 is provided inside the frame of the bin shift section 40. Motor M1 drives pinion gear PG through gears G1, G2. Since pinion gear PG meshes with rack gear RG fixed to the aforementioned stay 16, the frame of the bin shift section 40 is moved in the direction perpendicular to the surface of the drawing when motor M1 is rotated.

Numeral 18 is a roller which is provided on the shaft of the aforementioned pinion gear PG, and the roller 18 is slidably contacted with the aforementioned stay 16 to guide it.

FIG. 21 is a sectional view showing an essential portion of the sheet conveyance device.

A downward conveyance section 20 is connected with a paper discharge roller 2 and a paper discharge port 3 of the image forming apparatus 1, and discharged paper P is received by a guide plate 21 so that paper P can be conveyed downward. The downward conveyance section 20 includes a conveyance belt 22, rollers 233, 234 and press rollers 28A, 28B, 28C, 28D by which paper P is conveyed to a conveyance belt 13 provided in the aforementioned base 10. The aforementioned conveyance belt 22 is provided between a lower drive roller 231 and an upper idle roller 232, and intermediate rollers 233, 234 are provided inside the conveyance belt 22, and further a tension roller 225 is provided outside to give a tension to the conveyance belt 22. The aforementioned press rollers are mounted on a door 201 which can be freely opened and closed. The press rollers 28A, 28B, 28C which can be contacted with and separated from the aforementioned conveyance belt 22 are provided, and further the roller 28D is provided which presses the outer circumference of the aforementioned drive roller 231 through the conveyance belt 22 so that the conveyance belt 22 can be rotated to convey paper S.

The aforementioned door 201 is hinged to the lower portion of the case of the downward conveyance section 20 so that a jammed paper in the downward conveyance section 20 can be removed.

A paper discharge roller 24 and an intermediate tray 25 are provided which are used to discharge a previous paper in the image forming apparatus 1 when a jam is caused in an ADF and sorter branched from the aforementioned conveyance passage.

In the aforementioned intermediate tray 25, not only the aforementioned jammed paper but also special papers S1 are accommodated. Special paper P is defined as a paper, the size of which is smaller than the ordinary one (for example, B6 size, post card size, size of 5.5×8.5 inches, and the like), and further defined as a paper which is not suitable for conveyance in the sorter (for example, an OHP film, label paper, thin paper, and the like). The aforementioned special paper S1 is conveyed in the apparatus in such a manner that: according to a command sent from the image forming apparatus (for example, loading of a special cassette), special paper S1 is separated from the conveyance belt 22 by a branch means at the press roller 28C; and special paper S1 is conveyed by a paper discharge roller 24 composed of a drive roller 241 and an idle roller 242 along a guide plate 29, and discharged onto the intermediate tray 25.

Paper S2 which is required to be sorted, grouped and stapled, is advanced straight at the aforementioned branch point, conveyed being pinched by the conveyance belt 22 and the press roller 28D, conveyed to the base portion (the intermediate conveyance section) 10, and conveyed onto the conveyance belt 13 along the guide plate 19.

The aforementioned conveyance belt 13 is wrapped around the drive roller 141, idle roller 142, and tension roller 143, and slid on the support plate 144. The press rollers 13A, 13B, 13C, 13D are contacted with the upper surface of the conveyance belt 13 with pressure so that they can be rotated idly, and paper S2 is pinched by the conveyance belt 13 and press rollers and conveyed to the upward conveyance section 30.

In the upward conveyance section 30, rollers 33 and 32 are rotatably provided to the upper and lower portion the support frame, and a plurality of endless conveyance belts 31 are provided between the two rollers. A plurality of rollers 31 corresponding to the entrance of the bin are provided inside the conveyance belt 31. A plurality of conveyance rollers 35 are provided outside the conveyance belt 31 in such a manner that they are opposed to the rollers 34, so that the conveyance rollers 35 can be rotated idly by the conveyance belt 31.

A branch guide 36 is provided and oscillated between the conveyance rollers 35 at the entrance of each bin. This branch guide 36 is rotatably supported by a shaft 37 mounted on the aforementioned support frame, and oscillated by a lever and solenoid (not shown) installed at the end of the shaft 37. Accordingly, when the branch guide 36 is rotated clockwise, a lower claw portion of the branch guide 36 is crossed with the paper conveyance passage composed of the conveyance belt 31 and the conveyance roller 35 so that the upward advance of a paper is interrupted by the claw to receive the paper. When paper S2 is conveyed under the condition described above, paper S2 is curved along the inner curved surface of the branch guide 36 and received by the bin 41.

That is paper S2 is conveyed as follows:

Paper S2 (illustrated by a one-dotted chain line in the drawing) is conveyed into the upward conveyance section 30 at a high speed, conveyed upward being pinched by the conveyance belt 31 and the conveyance roller 35, curved to the right by the claw 36 (the second one from the bottom) which is oscillated clockwise by a solenoid not shown, and conveyed above a vertical stopper wall 41S of the bin 41. After that, paper S2 ascends along the inclined surface of the bin 41. After the trailing end of paper S2 has passed through the upper position of the aforementioned stopper 41S, paper S2 begins to descend, and slides down on the surface of the bin 41 by the action of gravity. Finally, the trailing end of paper S2 collides against the stopper wall 41S, and paper S2 is stopped.

Even when the trailing end of paper S2 is curled up, the curling can be prevented by the claw 41B provided on the top of the bin 41. Accordingly, paper S2 comes into contact with the stopper wall 41S by the action of gravity to be aligned.

A deep bottom type of non-sort tray 49 is provided above the uppermost bin 41 in a plurality of bins (20 steps of sort bins shown in FIG. 1). The non-sort tray 49 is a tray to accommodate non-sorted papers S3 on which images have been formed. On the non-sort tray, 200–300 sheets of papers can be stacked. Command and release of sorting and grouping can be selected through an operation panel provided on the image forming apparatus side.

On the other hand, in the case of a sorter provided with a stapler, in order to insert papers S2 into the stapler, all the bins 41 are advanced and withdrawn by motor M1 together with the bin moving section 40 correspondingly to the paper size, and further oscillated around a fixed shaft 43.

On the other hand, on a portion of the upward conveyance section 30, is mounted an alignment device 50 which aligns the side edge of paper S2 discharged onto the bin 41 from the image forming apparatus 1.

Figure 22:
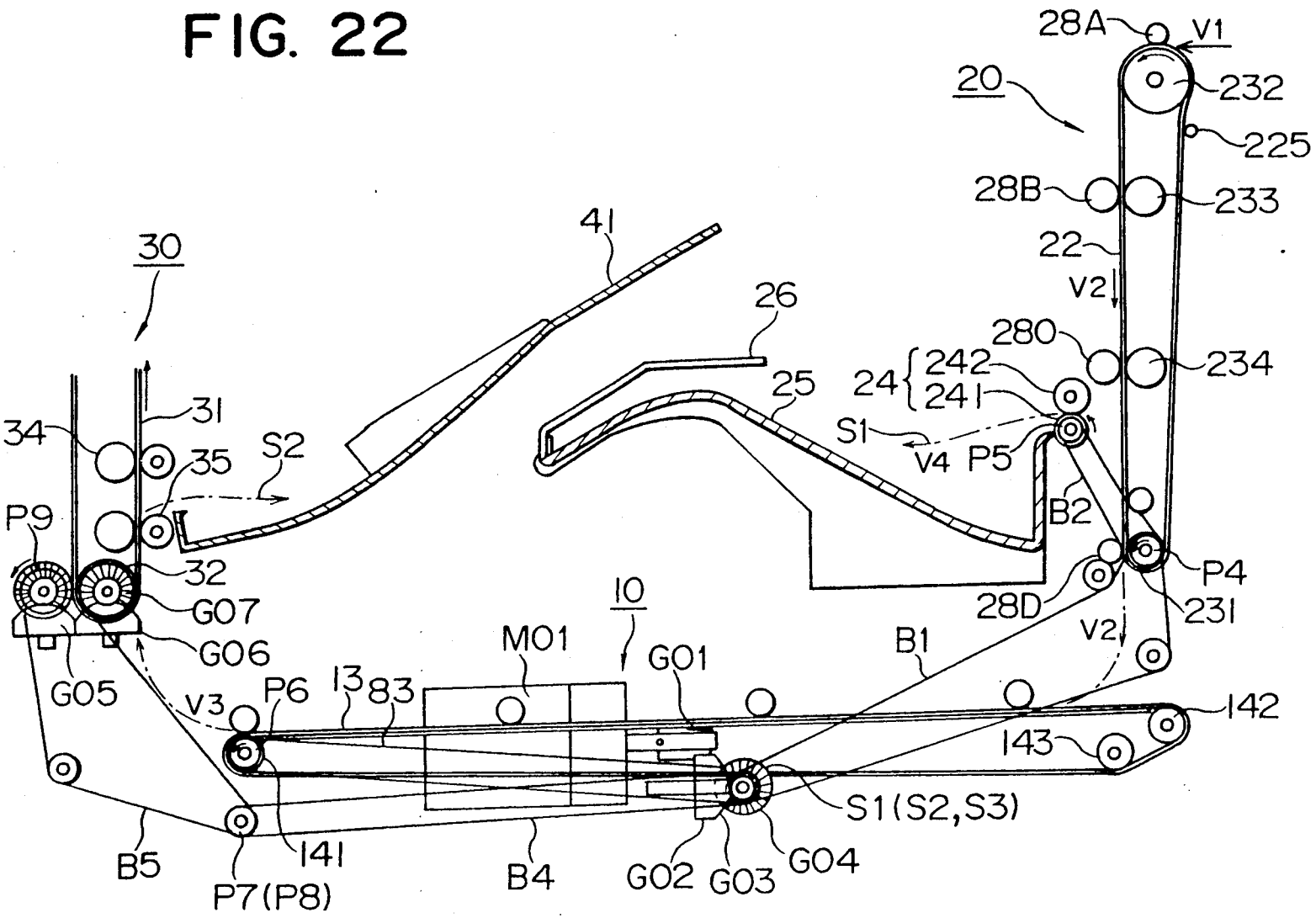
FIG. 22 is a sectional front view of the drive means of the sheet conveyance system of the aforementioned sorter.
Figure 23:
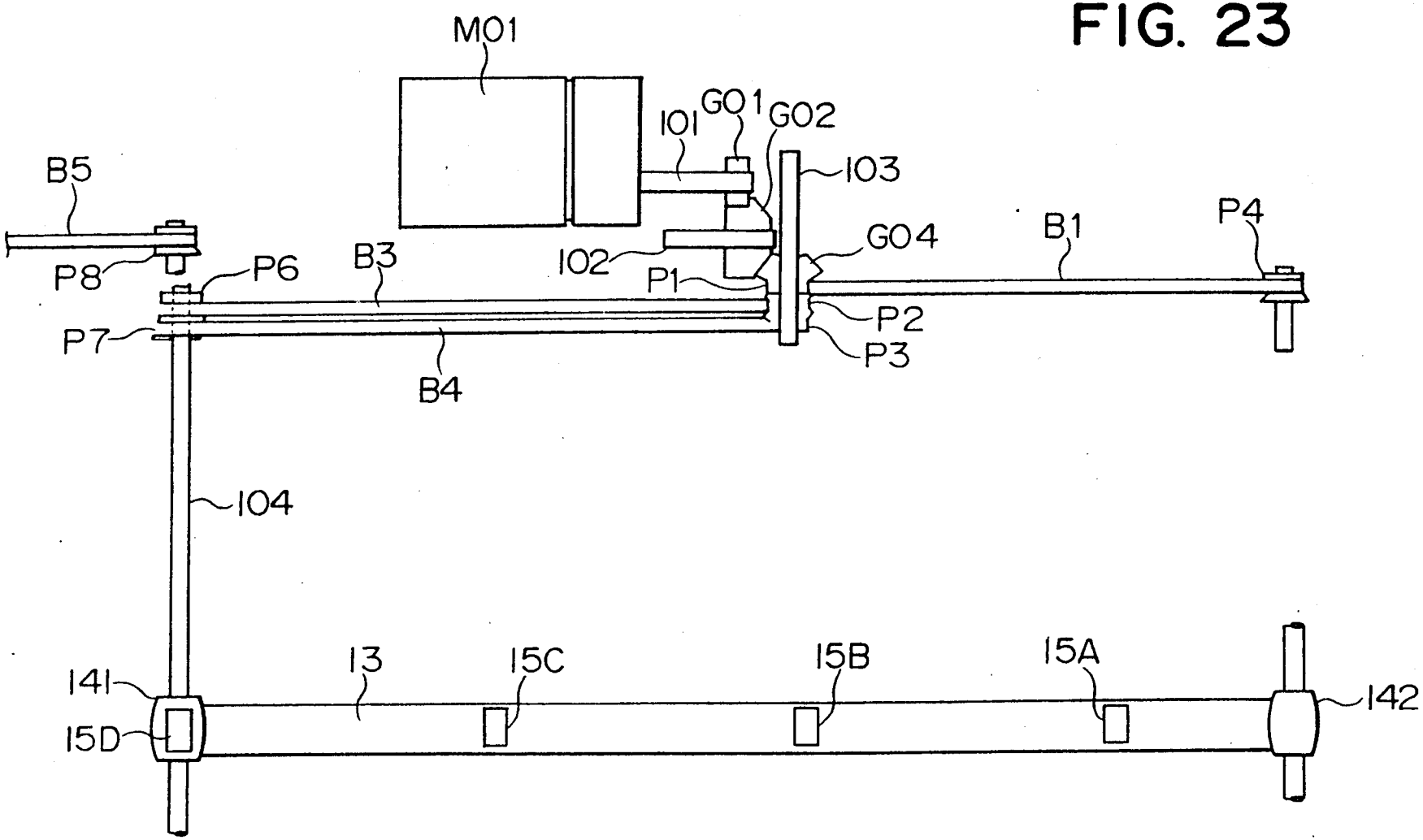
FIG. 23 is a plan view of the aforementioned drive means.

FIG. 22 is a sectional front view showing a drive means of the aforementioned paper conveyance system, and FIG. 23 is a plan view of the drive system.

A mechanism of the driving system is installed on the fur side of the aforementioned base 10 of the sorter. A rotary encoder is provided inside main motor (for example, a DC motor) M01 which is fixed to the base 10, and the rotating speed of this motor is adjustable. A reduction gear box is integrally connected with the aforementioned motor M01, and gear G01 is integrally mounted on the drive shaft 101. Gear G01 is engaged with spur gear G02 which is rotatably supported by an intermediate shaft 102. A bevel gear portion of the aforementioned gear G02 is engaged with bevel gear G04 which is rotatably supported by the second intermediate shaft making a right angle with the first intermediate shaft 102. Accordingly, the direction of power transmission can be deflected by a right angle.

Bevel gear G04 is integrally connected with 3 pulleys P1, P2, P3. Pulley P1 rotates pulley P4 through belt B1. A drive roller 231 is coaxially provided to pulley P4 to be rotated integrally. When the drive roller 231 is rotated, the conveyance belt 22 is driven. Linear velocity V2 (for example, 640 mm/sec) of the conveyance belt 22 is set to be higher than fixed paper discharging speed V1 (for example, 300 mm/sec) in the fixing unit 4 of the image forming apparatus 1 ($V2>V1$).

The leading edge of paper S discharged from the fixing unit 4 and paper discharging roller 2 at linear speed V1, is pinched by the conveyance belt 22 and press rollers 28A–28D and conveyed at linear speed V2. While the trailing edge of paper S is being strongly pinched by the aforementioned fixing unit 4, the leading edge of paper S slips and paper S is conveyed at linear speed V1. After the trailing edge of paper S has passed through the fixing unit 4, paper S is conveyed to the intermediate conveyance section 10 at linear speed V2 which is the same as that of the conveyance belt 22.

On the other hand, the aforementioned pulley P4 rotates pulley P5 through belt B2 so that a drive roller 241 of a paper discharging roller 24 is rotated since pulley P5 is integrated with the drive roller 241. Circumferential speed V4 of the aforementioned paper discharging roller 241 is set to be a little higher than linear conveyance speed V2 of the aforementioned conveyance belt 22 (for example, it is set to 650 mm/sec), or to be the same as linear conveyance speed V2. Paper S1 which is branched from the conveyance belt 22 and press roller 28C at linear speed V4, is discharged onto the intermediate tray 25.

The aforementioned pulley P2 rotates pulley P6 through belt B3.

A drive roller 141 is integrally provided to a rotating shaft 104 on which pulley P6 is mounted. The aforementioned conveyance belt 13 by which the drive roller 141 is wrapped, is rotated at linear speed V3 (for example, 740 mm/sec). Linear speed V3 of the conveyance belt 13 in the intermediate conveyance section 10, is set higher than linear speed V2 of the conveyance belt 22 in the aforementioned introducing section 20 ($V3>V2$).

On the other hand, the aforementioned pulley P3 rotates pulley P7 through belt B4. Pulley P7 and pulley P8 provided on the same shaft, rotate pulley P9 through belt B5. Pulley P9 and bevel gear G05 provided on the same shaft, rotate bevel gear G07 mounted on the shaft of the drive roller 32, through a bevel gear and spur gear portion of gear G05 provided on the intermediate shaft and through a spur gear and bevel gear portion of gear G06 provided on another intermediate shaft. When the drive roller 32 is rotated, the conveyance belt 31 is rotated at the same speed as linear speed V3 of the conveyance belt 13 in the intermediate conveyance section, or at a speed a little higher than that. Paper S2 is ascended and deflected to be accommodated in a predetermined bin 41 at the aforementioned linear speed of the conveyance belt 31.

Figure 24:
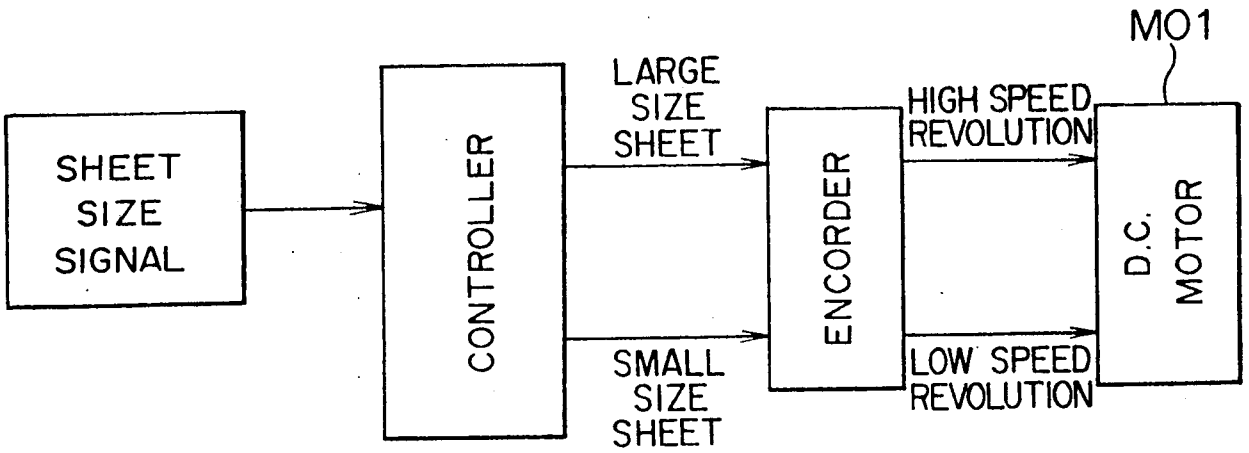
FIG. 24 is a block diagram of the sheet conveyance control means of the aforementioned sorter.
Figure 25:
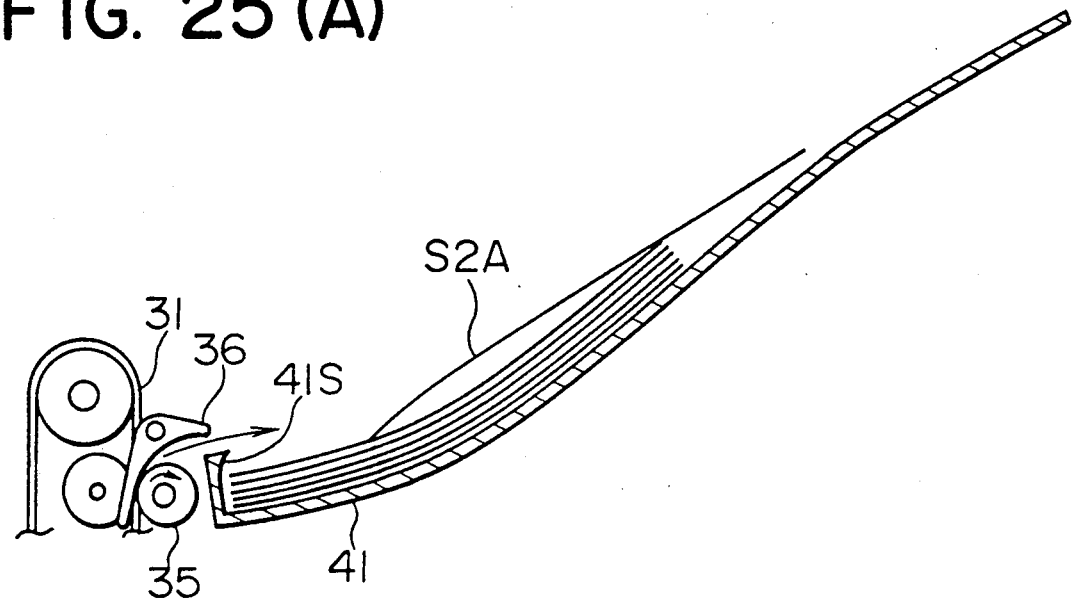
FIGS. 25A and 25B are schematic illustrations of a conventional example of a sorter by which different sizes of papers are discharged into a bin.
Figure 25:
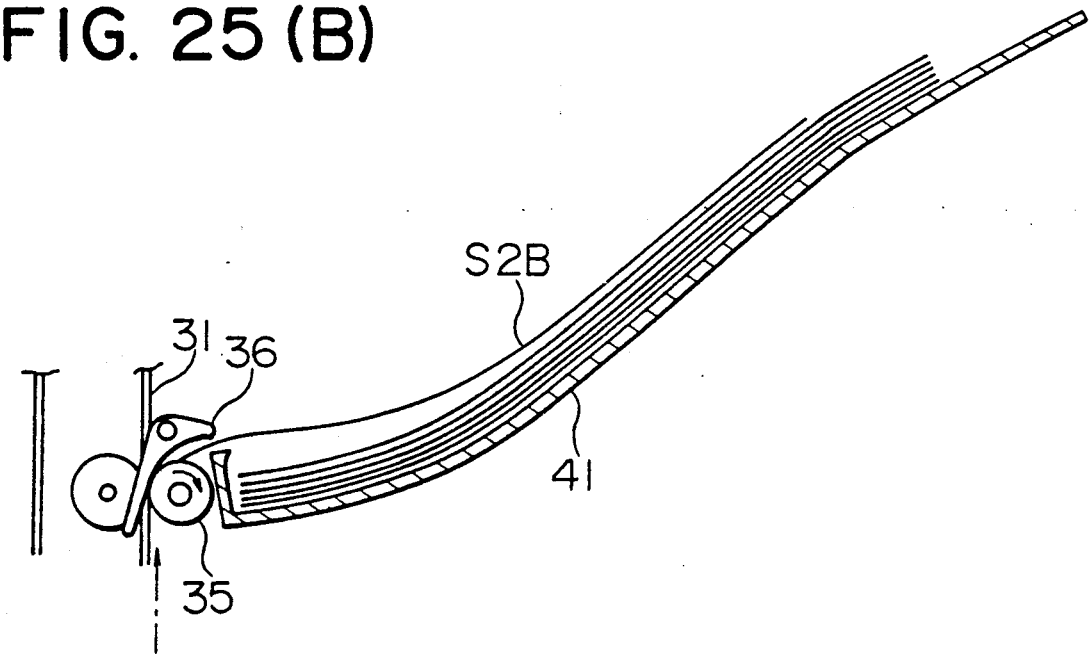

A discharging speed of a sheet which is accommodated in the bin 41, can be adjusted stepwise. FIG. 24 is a block diagram of the sheet conveyance control means.

When a size of recording paper S is set manually or automatically by an automatic paper feeding mechanism in accordance with the document size, the rotating speed of DC motor M01 is automatically selected according to a signal of the paper size. For example, a large-sized paper S2B is selected for A3 size and B4 size, paper S2*b* is discharged onto the bin 41 through the downward conveyance section (the introducing section) 20, the intermediate conveyance section 10, and the upward conveyance section 30 at a high speed of linear speed V3 (for example 740 mm/sec) of the aforementioned conveyance means. In this case, paper S2B is discharged at a high speed by a nip conveyance force between the conveyance belt 31 and the conveyance roller 35, and slid and ascended upward resisting a frictional force caused by the upper surface of a stacked paper. After the trailing end of paper S2B has passed through the upper position of the stopper wall 41S of the bin 41, paper S2B is descended, and slid on the surface of the stacked paper on the bin by the action of gravity. Finally, the trailing end of paper S2B collides with the stopper wall 41S, and paper S2B is stopped.

When it has been judged that paper S2 is of a small size (for example, B5 size or A4 size), the rotating speed of the aforementioned DC motor M01 is controlled by a control section and a rotary encoder provided inside motor M01, and the rotating speed is reduced. Due to the foregoing, linear speed V2 of the aforementioned conveyance means is lowered to 600–700 mm/sec. At the same time, linear speed V2 of the conveyance belt 22 and linear speed V4 of the paper discharge roller 24 are also lowered proportionally to the rotating speed of motor M01 at the same lowering rate as that of the aforementioned linear speed V3.

In the aforementioned embodiment, sheet sizes are classified into two so as to be judged, one is a large size and the other is a small size, and the sheet conveyance speed is varied into two steps. However, it is possible to classify the sheet sizes into not less than 3 sizes and to change over the sheet conveyance speed into not less than 3 steps.

As explained above, according to the fourth embodiment to accomplish the second object of the present invention, various sizes of sheets discharged from the image forming apparatus are discharged onto the bins of the sorter an an optimum discharging speed, so that problems such as misalignment and jam can be solved. Especially in the sorter in which a stapling and punching operation are conducted after a sorting process, paper alignment is important. Therefore, sheets stacked in the bins are orderly accommodated by the sheet conveyance speed control of the present invention so as to be processed later.

Figure 26:
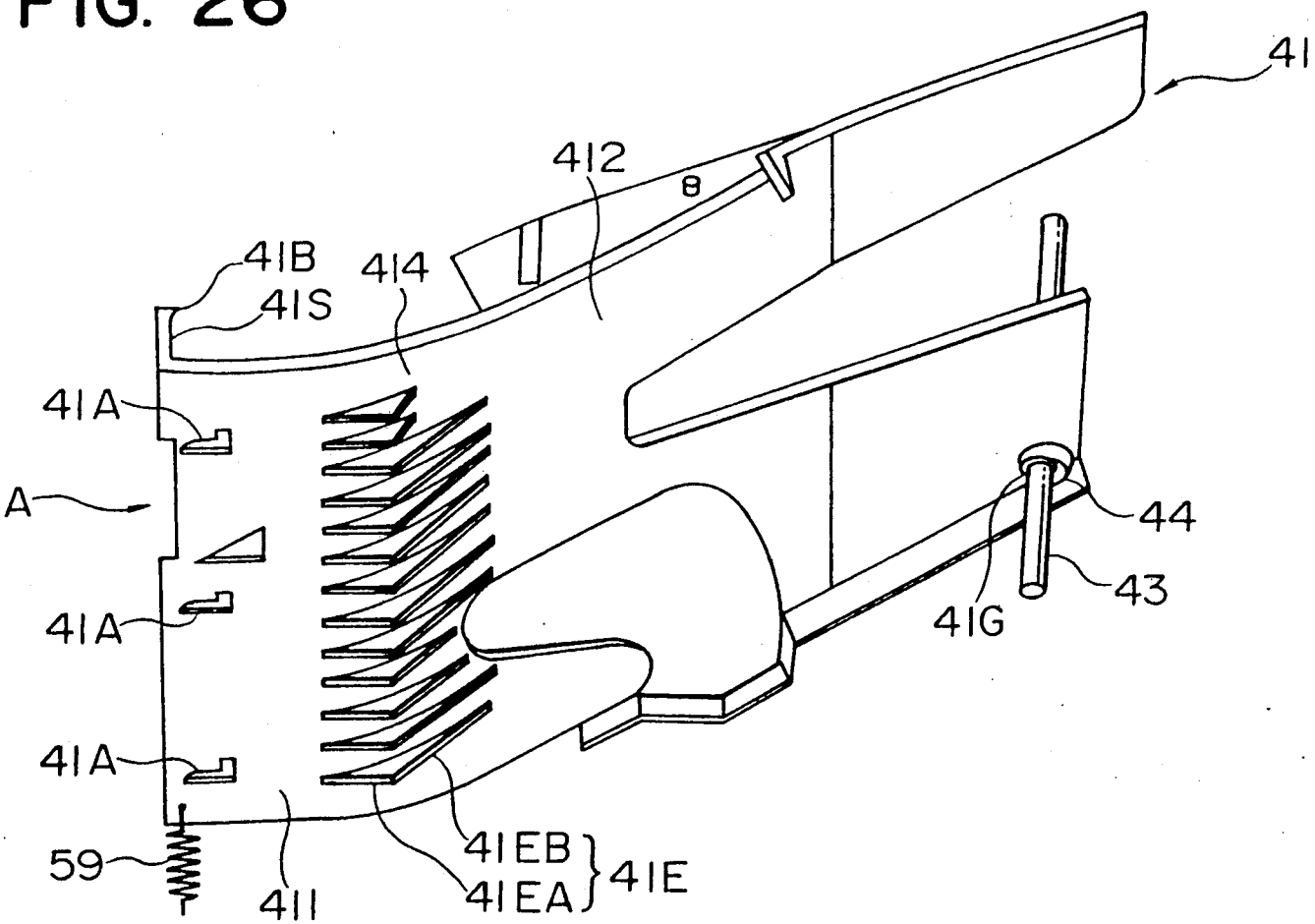
FIG. 26 is a perspective view taken from the bottom side of a bin.

In the aforementioned first to fourth embodiment, the rib and stopper wall can be formed into the following shapes. FIG. 26 is a perspective view of the bin 41 taken from the bottom side. A plurality of ribs 41E (inverse-triangle-shaped plates shown in the drawing) are integrally formed on the bottom side of each bin. The aforementioned ribs 41E are formed on the bottom side of a gently curved surface which connects a lower stack surface 411 having a gentle inclination angle with an intermediate stack surface 412 having a sharp inclination angle.

On the other hand, a space formed between an upper portion of the stopper wall 41S and claw 41B, and the guide plate 48 supporting the upper bin 41, is used for an opening through which sheets are conveyed. Therefore, the distance between the upper and lower bin close to the sheet conveyance section is sufficiently longer than the maximum stack height of the sheets. On the other hand, the distance between the immediate portion stack surfaces 412 of each bin 41 is set to be slightly longer than the maximum stack height of the sheets in order to make the sorter compact.

The aforementioned ribs 41E are disposed between a position close to the aforementioned sheet conveyance opening and the intermediate portion stack surface 412 in such a manner that: a distance between the protruded portion of the rib 41E provided on the bottom surface of the upper bin 41 and the curved surface 414 of the upper surface of the lower bin 41 can be approximately the same as the distance between the aforementioned intermediate stack surfaces 412.

A lower surface 41EA on which the aforementioned ribs 41E are formed, serves as a guide surface used when paper P is conveyed, and a right inclined surface 41EB serves as a guide surface used when paper P is reversed in the process of alignment.

Since the ribs are formed in the manner mentioned above, papers P which are introduced through the sheet conveyance opening, are regulated by the aforementioned ribs 41E so that the conveyance direction can be stabilized and a predetermined number of papers can be stably ensured in the stack.

The aforementioned plurality of stopper walls 41S are utilized for aligning the trailing ends of papers P, and it is preferable that papers of all sizes are contacted with a left end portion of the bin 41 shown in the drawing. However, in the case of a sorter in which the distances between the bins 41 are maintained minimum and the bins 41 are oscillated for stapling, an upper end portion of the stopper wall 41S sometimes contacts with collides against a bottom portion of the upper bin 41.

In order to avoid the interference and collision between the upper and lower bin, a portion on the vertical wall having the stopper wall 41S is cut out correspondingly to a portion in which the vertical wall surface interferes with the lower bin 41 (portion A in FIG. 26).

An auxiliary reference plate 47 is integrally fixed on the vertical surface of the guide plate 48 on which the rear end bottom surface the the bin 41 is provided, correspondingly to a position in which the aforementioned cut-out portion A of the bin 41 is formed. In order to make up for the stopper wall 41S which has been cut out, the auxiliary reference plate 47 is provided with three stopper walls 47S of the same shape. A curved claw 47B is protruded from the upper end on the vertical wall of the stopper wall 47S, and the shape of the claw 47B is the same as that of the aforementioned claw 41B. Under the condition that the bin 41 is closely contacted with the vertical surface 48A of the guide plate 48 being pushed by the spring 59, the aforementioned stopper wall 41S and 47S are disposed on the same surface to form a reference surface against which a trailing end of paper P collides.

Further, the shapes and heights of the claw portions 41B and 47B become the same. When the bin 41 is oscillated by a bin oscillating means 70 which will be described later, a bundle of papers are oscillated to a stapling position while the trailing ends of papers stacked on the bin 41 is being contacted with the stopper wall 41S on the bin. However, the stopper wall 47S provided on the auxiliary reference plate 47 fixed on the guide plate 48, is left in a fixed position. Consequently, when the upper bin 41 is oscillated, the stopper wall 47S of the lower bin never interferes with the bottom portion of the upper bin 41.

Figure 27:
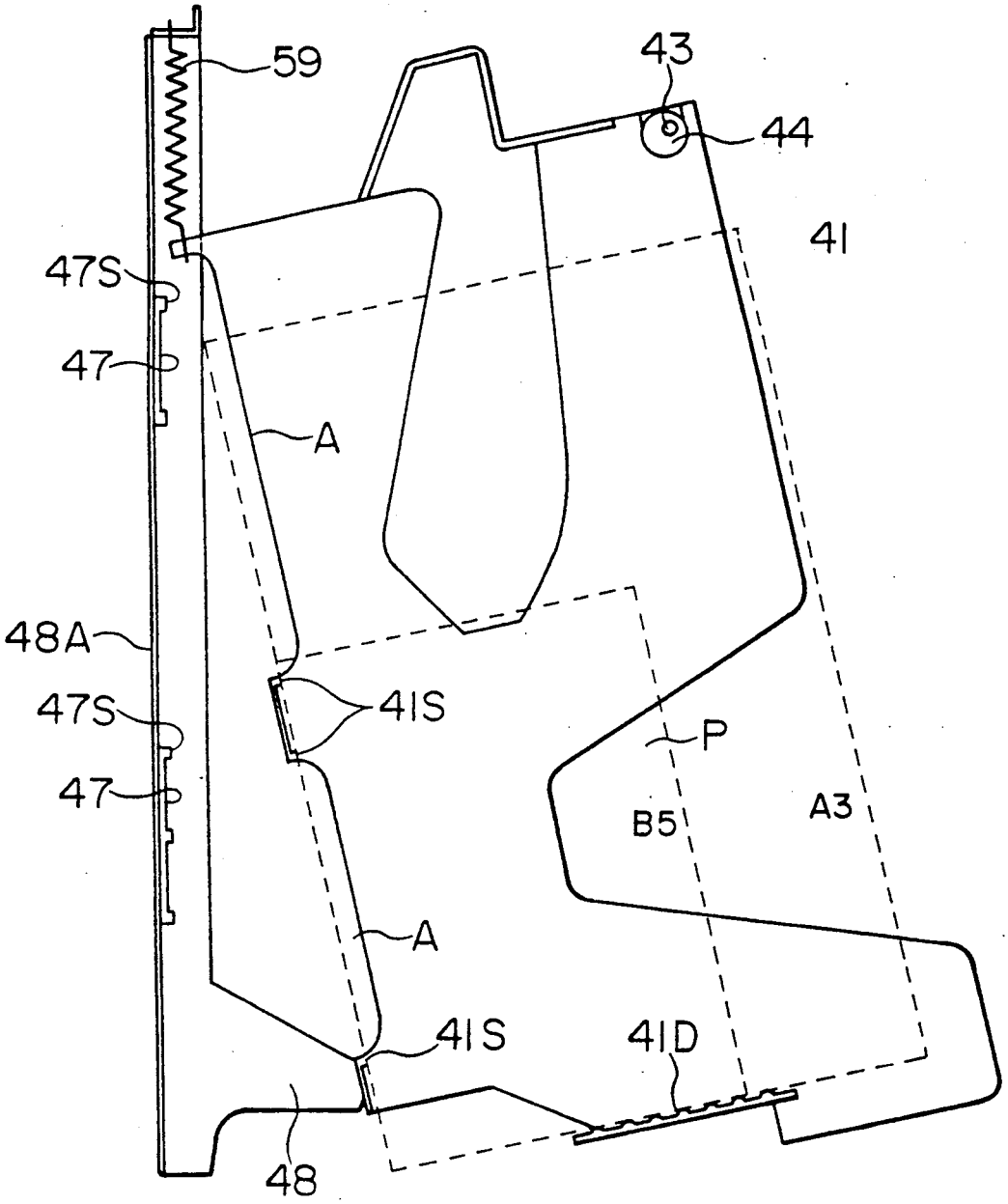
FIG. 27 is a plan view of a bin and guide plate showing another embodiment of the present invention.

FIG. 27 is a plan view showing another embodiment of the sorter according to the present invention. On a vertical wall of the bin 41, three stopper walls 41S are provided, two of them are located close to the center and one of them is located on this side in the drawing, and positioning is performed in such a manner that the trailing end of paper P is bumped against the stopper walls. On a portion of the vertical stopper wall except for the portion in which the stopper walls 41S are formed, two cut-out portions A are formed. On a vertical surface of the guide plate 48, are fixed two auxiliary reference plates 47 having the stopper wall 47S. As described above, when cut-out portion A is provided, it is effective for reducing the distance between the bins, and at the same time weight of the bin can be reduced.

According to the shape of the stopper wall explained above, when a large number of sheets are conveyed into a bin of a sorter, a bundle of sheets can be positively aligned, and further the distance between the bins can be minimized so that the number of sheets to be accommodated can be increased. When the distance between the bins is minimized, the total height of the sorter can be reduced, so that it is possible to make the apparatus compact. Especially in the case of a sorter provided with a stapler, when the bins are oscillated to the stapling position, the upper and lower bin do not interfere with each other, so that bin oscillation can be smoothly performed. When a portion of the stopper wall, vertical wall and paper stack surface of the bin are removed, weight of the bin can be reduced and inertia of the bin can be reduced in the bin oscillation process. Consequently, the bin stop position can be stabilized, and drive force can be reduced. Further, the drive force transmitting means can be effectively simplified.

Further, In the aforementioned first to fourth embodiment, the core bar 54A of the aforementioned alignment rod 54 is made of a light cylindrical hollow member such as a light alloy pipe (for example, an aluminum alloy pipe) and a light fiber reinforced plastic pipe. The outer circumferential surface (the diameter of which is about 8 mm) of the core bar 54A is coated with a resilient member 54B composed of a foaming resin member such as sponge. The alignment rod 54 composed of the aforementioned core bar 54A and the resilient member 54B, is light, so that inertia can be reduced when the aforementioned arms 52A, 52B are oscillated.

What is claimed is:

1. A sheet sorting apparatus for sorting a plurality of sheets into a plurality of groups and stapling said sheets by the group, said apparatus comprising:

means for sorting said sheets into a plurality of groups;

means for supporting each of said groups of sheets;

means for positioning the sheets of each of said groups in a setting position on said supporting means;

means for pressing the sheets of each of said groups onto said supporting means to fix said sheets of each of said groups in the setting position on said supporting means;

moving means for oscillating said supporting means to a stapling position, said pressing means setting said sheets of each of said groups at said setting position on said supporting means during movement of said supporting means to said stapling position; and means for stapling said sheets of each of said groups at said stapling position.

2. The apparatus of claim 1, wherein said supporting means includes a stopper surface means at which said sheets are aligned by said positioning means, said pressing means being located near said stopper surface means.

3. The apparatus of claim 2, wherein said stopper surface means is defined by an inner wall of said supporting means and a wall fixed at said setting position.

4. The apparatus of claim 1, wherein said supporting means includes a plurality of supporting trays and said positioning means is associated with all of said supporting trays, each of said supporting trays including an opening to receive said positioning means for access to said sheets on said supporting trays when said positioning means sets said sheets to said setting position and when said moving means oscillates said sheets to said stapling position.

5. The apparatus of claim 4, wherein said opening is reinforced by a reinforcement member.

6. The apparatus of claim , wherein each of said supporting trays is pivotally movable on a bearing fixed on a shaft so that said moving means pivots said supporting trays to said stapling position about said bearing, said reinforcement member retaining the pivotal relation of said bearing and a respective one of said supporting trays.

7. The apparatus of claim 4, wherein said positioning means includes;

a positioning bar for aligning said sheets;

an arm member for pivotally swinging said positioning bar; and an aligning bearing for movably supporting said positioning bar from said arm member.

8. The apparatus of claim 7, wherein said arm member is movable on an axis in three dimensions.

9. The apparatus of claim 7, wherein said positioning bar is coated with an elastic material.

10. The apparatus of claim 9, wherein said positioning bar has a tubular shape.

11. The apparatus of claim 7, wherein said aligning bearing supports said positioning ar from said arm member with a spring member, and wherein said positioning bar presses said sheets by a resilience of said spring member when said positioning means positions said sheets in the setting position.

12. The apparatus of claim 4, wherein said sorting means includes;

means for conveying said sheets to said supporting rays;

means for controlling a conveying speed of said conveying means according to the size of said sheets.

13. The apparatus of claim 1, wherein said pressing means fixes said sheets onto said supporting means before said moving means oscillates said sheets to said stapling position.

* * * * *

UNITED STATES PATENT AND TRADEMARK OFFICE

CERTIFICATE OF CORRECTION

PATENT NO. : 5,192,065

DATED : March 9, 1993

INVENTOR(S) : Kazuhiro HIROTA et al.

It is certified that error appears in the above-identified patent and that said Letters Patent is hereby corrected as shown below:

Claim 2, column 24, line 16, delete "a".

Claim 6, column 24, line 34, after "claim" insert --5--.

Claim 11, column 24, line 54, change "ar" to --bar--.

Claim 12, column 24, line 61, change "rays" to --trays--.

Signed and Sealed this

First Day of February, 1994

*Attest:*

Bruce Lehman

BRUCE LEHMAN

*Attesting Officer*

*Commissioner of Patents and Trademarks*